United States Patent [19]

Rhome

[11] Patent Number: 4,660,836

[45] Date of Patent: Apr. 28, 1987

[54] QUARTERBACK GAME

[76] Inventor: Jerry Rhome, 12673 Still Pond La., Herndon, Va. 22071

[21] Appl. No.: 744,721

[22] Filed: Jun. 14, 1985

[51] Int. Cl.[4] ..... A63F 3/00

[52] U.S. Cl. ..... 273/247; 273/94

[58] Field of Search ..... 273/247, 94 R

[56] References Cited

U.S. PATENT DOCUMENTS

| | | | |
|---|---|---|---|
| 563,767 | 7/1896 | Holland | 273/247 |
| 593,512 | 11/1897 | Cahalane | 273/247 |
| 795,822 | 8/1905 | Darius | 273/247 |
| 817,191 | 5/1906 | Robinson | 273/247 |
| 1,273,675 | 7/1918 | Schmitt | 273/247 |
| 1,467,912 | 9/1923 | Atkins | 273/247 |
| 1,838,398 | 1/1930 | Heidbrink | 273/247 |
| 1,992,475 | 2/1935 | De Hart | 273/247 |
| 2,049,284 | 7/1936 | Anderson | 273/247 |
| 3,043,594 | 7/1962 | Seitz | 273/247 |
| 3,103,361 | 9/1963 | Board | 273/247 |
| 3,526,403 | 9/1970 | Clark | 273/247 |
| 3,995,863 | 12/1976 | Cummins | 273/247 |
| 4,003,580 | 1/1977 | Haffey, Jr. | 273/247 |
| 4,094,509 | 6/1978 | Barron | 273/247 |
| 4,168,834 | 9/1979 | Mangiarelli | 273/247 |
| 4,173,346 | 11/1979 | Godwin | 273/247 |

*Primary Examiner*—Leo P. Picard
*Assistant Examiner*—Stuart W. Rose
*Attorney, Agent, or Firm*—Mark Lee Hogge

[57] ABSTRACT

A game simulating professional football is disclosed. An offense team chooses a play card. A defense team attempts to guess which play the offense has chosen. The degree of success in this attempt is assessed. The degree of success together with a random number obtained by a selector are both used to locate the play result from various probability result charts. The results are based on real events analogous to the degree of success the defense has in guessing what the offense will do.

12 Claims, 17 Drawing Figures

PASS CATEGORY

| DROP BACK PASS | | | | | | SPRINT OUT PASS | | | | | | FAKE RUN AND PASS | | | | | | SCREEN PASS | | | | |
|---|---|---|---|---|---|---|---|---|---|---|---|---|---|---|---|---|---|---|---|---|---|---|
| | CRUNCH | IN GRASP | HALF CLEAR | CLEAR | | | CRUNCH | IN GRASP | HALF CLEAR | CLEAR | | | CRUNCH | IN GRASP | HALF CLEAR | CLEAR | | | CRUNCH | IN GRASP | HALF CLEAR | CLEAR | |
| 1 | -2I | 6-12 | P | INC | 1 | 1 | F | S-10 | C20 | P | 1 | 1 | S-9 | C3 | 10I | C29 | 1 | 1 | INC | S-4 | C1 | C35 | 1 |
| 2 | S-10 | INC | INC | C43 | 2 | 2 | S-9 | C4 | C10 | INC | 2 | 2 | 3I | C13 | P | INC | 2 | 2 | P | INC | INC | P | 2 |
| 3 | 3I | C2 | C1 | C30 | 3 | 3 | INC | INC | INC | C1 | 3 | 3 | INC | C7 | INC | C10 | 3 | 3 | S-8 | INC | C10 | C7 | 3 |
| 4 | S-11 | 20I | 17I | C18 | 4 | 4 | P | Q6 | C27 | C10 | 4 | 4 | S-4 | 7I | Q4 | C37 | 4 | 4 | INC | C1 | P | C13 | 4 |
| 5 | 7I | C26 | S-5 | C22 | 5 | 5 | INC | C9 | Q12 | C9 | 5 | 5 | P | C4 | C5 | C7 | 5 | 5 | S-9 | C5 | C3 | C26 | 5 |
| 6 | INC | S-11 | C6 | Q5 | 6 | 6 | 6I | C4 | C5 | Q22 | 6 | 6 | INC | INC | C13 | C64 | 6 | 6 | 3F | C13 | C13 | C3 | 6 |
| 7 | S-12 | P | C19 | C38 | 7 | 7 | INC | 8I | C1 | C34 | 7 | 7 | S-8 | S-9 | C45 | C27 | 7 | 7 | INC | INC | 6F | INC | 7 |
| 8 | S-10 | C-1 | C7 | C8 | 8 | 8 | Q7 | INC | C36 | C8 | 8 | 8 | S-5 | INC | S-6 | INC | 8 | 8 | -4I | C7 | C2 | C5 | 8 |
| 9 | 4-I | INC | Q4 | C56 | 9 | 9 | S-10 | S-5 | C8 | C16 | 9 | 9 | INC | C7 | C1 | C1 | 9 | 9 | S-4 | C2 | C16 | C38 | 9 |
| 10 | S-13 | C8 | INC | P | 10 | 10 | INC | C3 | C3 | 21I | 10 | 10 | S-7 | INC | C23 | C30 | 10 | 10 | INC | C3 | S-7 | C10 | 10 |
| 11 | INC | 22I | C5 | C17 | 11 | 11 | S-8 | S-8 | S-7 | C14 | 11 | 11 | 16I | P | Q11 | C12 | 11 | 11 | P | -4I | INC | C14 | 11 |
| 12 | S-9 | S-10 | S-6 | INC | 12 | 12 | S-7 | INC | C4 | INC | 12 | 12 | S-10 | C6 | C17 | C44 | 12 | 12 | INC | INC | P | C6 | 12 |
| 13 | -5I | Q4 | C16 | C33 | 13 | 13 | 7I | C7 | C46 | C29 | 13 | 13 | INC | INC | INC | C25 | 13 | 13 | INC | Q5 | INC | C15 | 13 |
| 14 | S-8 | INC | INC | C4 | 14 | 14 | INC | -5F | C19 | C8 | 14 | 14 | Q6 | 6I | C15 | C6 | 14 | 14 | -2F | C6 | C3 | C4 | 14 |
| 15 | P | S-6 | 7I | P | 15 | 15 | INC | INC | P | C4 | 15 | 15 | INC | C1 | C2 | 16I | 15 | 15 | C3 | P | C9 | C49 | 15 |
| 16 | INC | INC | C45 | C5 | 16 | 16 | C2 | C2 | INC | INC | 16 | 16 | 12I | S-7 | P | C3 | 16 | 16 | INC | INC | C6 | C15 | 16 |
| 17 | -9F | P | Q7 | C3 | 17 | 17 | 3I | 17I | C7 | C46 | 17 | 17 | S-7 | INC | C21 | INC | 17 | 17 | INC | S-8 | INC | C4 | 17 |
| 18 | S-7 | C7 | C3 | 18I | 18 | 18 | S-7 | INC | 17I | C15 | 18 | 18 | P | S-10 | C8 | C46 | 18 | 18 | C2 | INC | C4 | P | 18 |
| 19 | C3 | 7I | C2 | INC | 19 | 19 | 19I | Q13 | C6 | C12 | 19 | 19 | INC | Q5 | S-9 | C22 | 19 | 19 | -6I | C2 | Q13 | INC | 19 |
| 20 | S-6 | C9 | INC | C7 | 20 | 20 | INC | P | C4 | C3 | 20 | 20 | S-10 | INC | INC | C8 | 20 | 20 | INC | C4 | C5 | C7 | 20 |
| 21 | 20I | INC | C8 | C51 | 21 | 21 | S-10 | C8 | INC | C7 | 21 | 21 | 2I | C2 | C7 | C9 | 21 | 21 | INC | C9 | C9 | C4 | 21 |
| 22 | INC | S-7 | P | C24 | 22 | 22 | INC | S9 | Q5 | P | 22 | 22 | S-13 | P | Q6 | Q13 | 22 | 22 | INC | S-5 | -5I | C8 | 22 |
| 23 | S-10 | -5F | C13 | C2 | 23 | 23 | 14I | 22I | C17 | C2 | 23 | 23 | 3F | INC | C34 | C54 | 23 | 23 | S-10 | C4 | C8 | C20 | 23 |
| 24 | S-5 | Q6 | S-7 | C16 | 24 | 24 | S-6 | INC | S-9 | C10 | 24 | 24 | INC | 14I | INC | P | 24 | 24 | S-5 | C8 | C4 | C19 | 24 |
| 25 | F | 14I | C3 | C25 | 25 | 25 | Q3 | C1 | C2 | Q10 | 25 | 25 | Q4 | INC | C3 | C7 | 25 | 25 | INC | 4F | C3 | C25 | 25 |
| 26 | S-7 | C7 | C21 | C6 | 26 | 26 | -3I | C5 | C7 | C7 | 26 | 26 | 14I | C5 | C6 | C25 | 26 | 26 | P | INC | INC | C25 | 26 |
| 27 | 16I | INC | C4 | C20 | 27 | 27 | INC | P | INC | C27 | 27 | 27 | INC | S-8 | C4 | C14 | 27 | 27 | INC | C3 | S-5 | C3 | 27 |
| 28 | S-9 | P | INC | C6 | 28 | 28 | S-13 | INC | C8 | C20 | 28 | 28 | 1 | INC | C10 | C33 | 28 | 28 | S-7 | S-7 | P | C3 | 28 |
| 29 | -7F | S-8 | C4 | C15 | 29 | 29 | 5F | C3 | 25I | C6 | 29 | 29 | S-11 | Q12 | INC | Q5 | 29 | 29 | INC | C3 | C2 | Q14 | 29 |
| 30 | P | C3 | S-8 | C14 | 30 | 30 | 5I | C25 | INC | C25 | 30 | 30 | INC | C4 | C8 | C8 | 30 | 30 | -6F | INC | C19 | C30 | 30 |
| 31 | S-8 | C13 | C24 | C49 | 31 | 31 | INC | S-7 | P | C54 | 31 | 31 | 8I | -7F | C4 | INC | 31 | 31 | S-7 | C4 | C24 | C8 | 31 |
| 32 | S-5 | S-7 | C10 | Q20 | 32 | 32 | P | C7 | C16 | C6 | 32 | 32 | F | INC | S-5 | C18 | 32 | 32 | INC | INC | INC | C7 | 32 |
| 33 | S-7 | C3 | C26 | INC | 33 | 33 | S-5 | INC | INC | INC | 33 | 33 | INC | C9 | C7 | C6 | 33 | 33 | -5I | C23 | C7 | C9 | 33 |
| 34 | 14I | S9 | C12 | C8 | 34 | 34 | INC | C6 | C24 | C37 | 34 | 34 | S-6 | S-5 | INC | INC | 34 | 34 | S11 | INC | Q6 | -3I | 34 |
| 35 | Q4 | Q12 | 26I | C65 | 35 | 35 | INC | INC | S-5 | C5 | 35 | 35 | INC | 22I | C28 | P | 35 | 35 | INC | C6 | S-6 | C24 | 35 |
| 36 | S-6 | S-5 | Q12 | C26 | 36 | 36 | 8I | 11I | INC | P | 36 | 36 | 5I | C3 | INC | C20 | 36 | 36 | 3I | C2 | C10 | C56 | 36 |
| 37 | 17I | INC | C37 | C7 | 37 | 37 | S-5 | C2 | C2 | C4 | 37 | 37 | S-12 | Q4 | C3 | C15 | 37 | 37 | INC | Q11 | C4 | C8 | 37 |
| 38 | S-4 | S-3 | C8 | C10 | 38 | 38 | S-11 | P | 14I | Q4 | 38 | 38 | 3I | C24 | INC | C16 | 38 | 38 | -7I | C7 | C7 | C6 | 38 |
| 39 | S-9 | C6 | INC | C12 | 39 | 39 | INC | INC | C9 | C25 | 39 | 39 | INC | S-7 | 15I | C3 | 39 | 39 | Q3 | S-6 | C3 | C2 | 39 |
| 40 | S-5 | INC | S-4 | C75 | 40 | 40 | 17I | Q3 | Q7 | C3 | 40 | 40 | -2I | C8 | C2 | Q20 | 40 | 40 | S-6 | INC | INC | C2 | 40 |
| 41 | 10I | S-5 | C28 | Q12 | 41 | 41 | INC | INC | INC | C30 | 41 | 41 | S-5 | C2 | C9 | C4 | 41 | 41 | F | P | C6 | P | 41 |
| 42 | P | C5 | P | C10 | 42 | 42 | P | S-6 | C3 | C23 | 42 | 42 | INC | 26I | P | C4 | 42 | 42 | INC | C1 | C26 | Q7 | 42 |
| 43 | INC | C4 | C32 | INC | 43 | 43 | S12 | 12I | S-6 | C42 | 43 | 43 | INC | INC | INC | C10 | 43 | 43 | -2I | -3I | C37 | C9 | 43 |
| 44 | S-4 | -3I | INC | C28 | 44 | 44 | S-4 | INC | C14 | INC | 44 | 44 | 10I | S-6 | C19 | C5 | 44 | 44 | INC | P | INC | C17 | 44 |
| 45 | 8I | INC | C9 | P | 45 | 45 | 10I | S-5 | P | C63 | 45 | 45 | INC | P | 21I | P | 45 | 45 | INC | S-5 | C8 | C43 | 45 |
| 46 | C2 | S-4 | INC | C9 | 46 | 46 | INC | C14 | INC | C18 | 46 | 46 | C2 | INC | S-7 | INC | 46 | 46 | S-5 | INC | C5 | INC | 46 |
| | CRUNCH | IN GRASP | HALF CLEAR | CLEAR | | | CRUNCH | IN GRASP | HALF CLEAR | CLEAR | | | CRUNCH | IN GRASP | HALF CLEAR | CLEAR | | | CRUNCH | IN GRASP | HALF CLEAR | CLEAR | |
| DROP BACK PASS | | | | | | SPRINT OUT PASS | | | | | | FAKE RUN AND PASS | | | | | | SCREEN PASS | | | | |

PASS CATEGORY

FIG. 4

"OUTSIDE RUN CATEGORY"

| END RUN | | | | COUNTER RUN | | | | | POWER SWEEP | | | | | REVERSE | | | | |
|---|---|---|---|---|---|---|---|---|---|---|---|---|---|---|---|---|---|---|
| CRUNCH | IN GRASP | HALF CLEAR | CLEAR | | CRUNCH | IN GRASP | HALF CLEAR | CLEAR | | CRUNCH | IN GRASP | HALF CLEAR | CLEAR | | CRUNCH | IN GRASP | HALF CLEAR | CLEAR |
| -9 | 7 | 16 | 76 | 1 | P | 1 | 9 | 10 | 1 | -7F | 1 | 9 | P | 1 | -3F | 5 | P | 7 | 1 |
| -2F | 1 | -4 | 18 | 2 | -7F | F | 11 | P | 2 | -1 | 0 | 4 | 3 | 2 | -11 | 0 | 17 | 46 | 2 |
| -1 | 0 | 26 | P | 3 | 0 | 0 | 8 | 8 | 3 | 0 | P | 8 | 4 | 3 | -1 | 1 | 3F | 33 | 3 |
| -2 | -3F | 0 | 5 | 4 | -2 | -1 | 4 | 0 | 4 | P | -2 | 3 | 56 | 4 | P | -5 | 29 | 4 | 4 |
| -8F | 2 | 4 | 33 | 5 | F | 13 | 0 | 9 | 5 | -2 | 4 | -1 | 6 | 5 | -5 | -4 | 44 | 17 | 5 |
| 0 | 9 | 9 | 1 | 6 | 0 | 5 | 46 | 45 | 6 | -10 | -3 | 0 | 2 | 6 | -2F | -6 | 36 | 0 | 6 |
| -12 | P | -2F | 24 | 7 | -8 | -6 | 3 | 8 | 7 | -3 | 0 | 5 | 34 | 7 | -9 | -7 | 8 | 10 | 7 |
| -4F | -2F | 7 | 5 | 8 | -3F | P | 0 | 4 | 8 | -5F | 5 | 10 | 18 | 8 | 0 | -2F | 5 | 53 | 8 |
| 0 | -5 | -6 | 0 | 9 | -3 | 2 | -3F | 1 | 9 | 1 | 2 | 16 | 28 | 9 | -4 | -4 | 1 | 25 | 9 |
| F | -4 | 6 | 6 | 10 | 1 | 0 | -1 | -1 | 10 | 0 | -4 | 0 | 5 | 10 | 2 | -P | 8 | -8 | 10 |
| -5 | 3 | -3 | -4F | 11 | 0 | 1 | 7 | P | 11 | F | -3F | 38 | 0 | 11 | -7F | 2 | 7 | 44 | 11 |
| -10 | -10 | P | -2 | 12 | -6F | -8 | 39 | 13 | 12 | -3 | -6 | 0 | 30 | 12 | -5 | 0 | 0 | 15 | 12 |
| 1 | 0 | 3 | 51 | 13 | -1 | 0 | P | 28 | 13 | 0 | -5 | 1 | 9 | 13 | -3 | 14 | -4 | 38 | 13 |
| -3 | -5 | 31 | 0 | 14 | -12 | -2 | 13 | 3 | 14 | -6F | 4 | -2 | 1 | 14 | P | 6 | 2 | 5 | 14 |
| -13F | -4 | 2 | 12 | 15 | -9 | -2F | 5 | 7 | 15 | -2 | -1 | 2 | 3F | 15 | -7 | -4F | 19 | 9 | 15 |
| -10F | 8 | 8 | P | 16 | F | 17 | -2 | 10 | 16 | -4 | P | 45 | 17 | 16 | -10 | 3 | 4 | P | 16 |
| -5 | -2 | 27 | 3 | 17 | -7 | 2 | 3 | 5F | 17 | -4 | 8 | 0 | -2 | 17 | -8F | -8 | 5 | 16 | 17 |
| 0 | -3 | 18 | 3 | 18 | -3 | 0 | -5 | 0 | 18 | -12 | 3 | P | -1 | 18 | 0 | -3 | 0 | 20 | 18 |
| P | 0 | 0 | 7 | 19 | 0 | -1 | 0 | 7 | 19 | F | 6 | 5 | 6 | 19 | -12F | -9 | P | 3 | 19 |
| -4 | -2 | 5 | 37 | 20 | 2 | -5 | 32 | -2 | 20 | 1 | -10 | 18 | 7 | 20 | -3 | 4 | -7 | 67 | 20 |
| -4 | -9 | 3 | 7 | 21 | -4F | -3 | 6 | 57 | 21 | P | -5F | -3 | 42 | 21 | -8 | -2 | 34 | 0 | 21 |
| -12F | -6F | P | 10 | 22 | -10 | 6 | 1 | 15 | 22 | -9 | 0 | 2 | 3 | 22 | 3F | -5 | 3 | 25 | 22 |
| -14 | -13 | 0 | 15 | 23 | -4 | 0 | -4 | 15 | 23 | 2 | 4 | 0 | 5 | 23 | -2 | 0 | F | 15 | 23 |
| -1 | 24 | 6 | 7 | 24 | 3 | 1 | 10 | 0 | 24 | 0 | 0 | 6 | 16 | 24 | F | -3 | 15 | 3 | 24 |
| -8 | 7 | -1F | 20 | 25 | -1 | -2 | 7 | 6 | 25 | -4F | -2 | P | 0 | 25 | -13 | 7 | 6 | 54 | 25 |
| 0 | 4 | 8 | 14 | 26 | -1F | 0 | 2 | 43 | 26 | -3 | -1 | 33 | 26 | 26 | 0 | -14 | 0 | 9 | 26 |
| -6F | P | 4 | 2 | 27 | 0 | 3 | 6 | 3 | 27 | 3 | 3 | 3 | 7 | 27 | -7F | 13 | -3 | -2 | 27 |
| -8 | 15 | 1 | P | 28 | -4 | -3 | 17 | 17 | 28 | 0 | -5 | -4F | 0 | 28 | -7 | 3 | 22 | P | 28 |
| -2 | 2 | 35 | 3 | 29 | -3F | P | -5F | 37 | 29 | -5 | 14 | 9 | P | 29 | F | -10 | 4 | 7 | 29 |
| 2F | 3 | 14 | 20 | 30 | -2 | 0 | 2 | 6 | 30 | -8 | -3 | 3 | 25 | 30 | -4 | -10F | 0 | 28 | 30 |
| -7 | -1 | 2 | 0 | 31 | 0 | -9 | 8 | 2 | 31 | -4 | 8 | 7 | 15 | 31 | -7 | 0 | 3 | 0 | 31 |
| P | 17 | 7 | 17 | 32 | -4 | 3 | 0 | 15 | 32 | -1 | 3 | -4 | 46 | 32 | 2 | -1 | P | 2 | 32 |
| F | -8 | 10 | 66 | 33 | -2F | -4 | 9 | P | 33 | -3F | 0 | 6 | 7 | 33 | -5F | 8 | 7 | 11 | 33 |
| -7 | 6 | 23 | 9 | 34 | 4 | 4 | 3 | 5 | 34 | -4 | 2 | P | 4 | 34 | F | -1 | 9 | 32 | 34 |
| -7F | 0 | 0 | 16 | 35 | P | 2 | P | 8 | 35 | F | 16 | 28 | 1 | 35 | 0 | -2 | 27 | 12 | 35 |
| 4 | 2 | -2 | 31 | 36 | -6 | -3F | 27 | 18 | 36 | -7 | -3F | 14 | 8 | 36 | -1 | P | -2 | P | 36 |
| -5 | P | 5F | 8 | 37 | -5 | 0 | 2 | 4 | 37 | -5 | 1 | 4 | 23 | 37 | -8 | 0 | -1 | 30 | 37 |
| 0 | 1 | 1 | 15 | 38 | -5 | 3 | 19 | 1 | 38 | -7 | 0 | -2F | 20 | 38 | -5 | 28 | 2 | 24 | 38 |
| -9F | -4F | 12 | 25 | 39 | 0 | P | 0 | 32 | 39 | 0 | 2 | 8 | 13 | 39 | -9F | -5F | -6F | 19 | 39 |
| -3 | -7 | 0 | 43 | 40 | -3 | 8 | -3 | 20 | 40 | -2F | P | 2 | 8 | 40 | -17 | 0 | 0 | -2F | 40 |
| P | 0 | 46 | 4 | 41 | -7 | -5 | P | 9 | 41 | -6 | -4 | 24 | P | 41 | P | 9 | 13 | 6 | 41 |
| -5F | -1 | -1 | 9 | 42 | F | 4 | 4 | 25 | 42 | 4 | 0 | 12 | 15 | 42 | -6F | 2 | 1 | 1 | 42 |
| -18 | -6 | -9 | 55 | 43 | -5 | -4 | 25 | 22 | 43 | -5 | 1F | -5 | 10 | 43 | 1 | -6F | 10 | 27 | 43 |
| F | 5 | 21 | 29 | 44 | P | 9 | 0 | 30 | 44 | P | 9 | 1 | 11 | 44 | 0 | 8 | 8 | 5 | 44 |
| -7 | 0 | P | 13 | 45 | -4 | 4 | 1 | 19 | 45 | 0 | 0 | 7 | 9 | 45 | -14F | P | 11 | 73 | 45 |
| -6 | -9F | 10 | 30 | 46 | 1 | -5F | 5 | 5 | 46 | -1F | 1 | 0 | 39 | 46 | -6 | 1 | 24 | 18 | 46 |
| CRUNCH | IN GRASP | HALF CLEAR | CLEAR | | CRUNCH | IN GRASP | HALF CLEAR | CLEAR | | CRUNCH | IN GRASP | HALF CLEAR | CLEAR | | CRUNCH | IN GRASP | HALF CLEAR | CLEAR |
| END RUN | | | | COUNTER RUN | | | | | POWER SWEEP | | | | | REVERSE | | | | |

"OUTSIDE RUN CATEGORY"

FIG. 5

"INSIDE RUN CATEGORY"

| UP MIDDLE | | | | OFF TACKLE | | | | | DRAW | | | | | WEAKSIDE TRAP | | | | | |
|---|---|---|---|---|---|---|---|---|---|---|---|---|---|---|---|---|---|---|---|
| CRUNCH | IN GRASP | HALF CLEAR | CLEAR | | CRUNCH | IN GRASP | HALF CLEAR | CLEAR | | CRUNCH | IN GRASP | HALF CLEAR | CLEAR | | CRUNCH | IN GRASP | HALF CLEAR | CLEAR | |
| -5 | 2 | 5 | 5 | 1 | P | 1 | 12 | 9 | 1 | -1 | 0 | P | 38 | 1 | -1 | 1 | P | 15 | 1 |
| 0 | P | 4 | 4 | 2 | -1 | 0 | 5 | 30 | 2 | -8F | -5 | 1 | 5 | 2 | -3 | -4 | 11 | 5 | 2 |
| -4 | 0 | 3 | 0 | 3 | -7 | 9 | 0 | 25 | 3 | 1 | 13 | 25 | 0 | 3 | F | 9 | 5 | 22 | 3 |
| P | -5 | 6 | P | 4 | -6F | -4 | 4F | 14 | 4 | 0 | P | 5 | 29 | 4 | -9 | -5 | 0 | 9 | 4 |
| 0 | 1 | 0 | 10 | 5 | -8 | P | -4 | 3 | 5 | 2 | 2 | -3 | -2 | 5 | -7F | -4 | 3 | P | 5 |
| -4 | 9 | 25 | 38 | 6 | -6 | 0 | 2 | 8 | 6 | -2 | 0 | 16 | 14 | 6 | 0 | -3 | -1 | 3 | 6 |
| -5F | 0 | 0 | 3 | 7 | -2 | 2 | -5 | 56 | 7 | -9 | 3 | 0 | 43 | 7 | -2 | P | -3 | 39 | 7 |
| -3 | -4 | 10 | 18 | 8 | 2 | -2F | 0 | 15 | 8 | 2 | -6F | -2 | -1 | 8 | -1F | -6 | 1 | 2 | 8 |
| 0 | -3 | -5 | 0 | 9 | 0 | -4 | 1 | 4 | 9 | -4 | -4 | 2 | 6 | 9 | -8 | F | 0 | 8 | 9 |
| 1 | 0 | 2 | 24 | 10 | -9 | -3 | P | 5 | 10 | -6F | -5 | 36 | 0 | 10 | 0 | 0 | 27 | 30 | 10 |
| -2 | -3F | 12 | 8 | 11 | -5F | 0 | 6 | 2 | 11 | -4 | 15 | 5 | 6 | 11 | -4 | 13 | 6 | 17 | 11 |
| -4 | 8 | 7 | 2 | 12 | -5 | 3 | 0 | 26 | 12 | F | 4 | 0 | 27 | 12 | -2F | -2 | -2 | 4 | 12 |
| -10 | -8 | 1 | 6 | 13 | -4 | -5 | 7 | -2 | 13 | 0 | -7 | -8 | P | 13 | -7 | 4 | 2 | 1 | 13 |
| F | 13 | 7 | 2F | 14 | -5 | 4 | 4 | 20 | 14 | -13 | -5 | 17 | 10 | 14 | 0 | P | 0 | 19 | 14 |
| 0 | 0 | P | 1 | 15 | -4 | 12 | 44 | 3 | 15 | -2F | 3 | 6 | 35 | 15 | -5 | 0 | 9 | 25 | 15 |
| 2 | -3 | 0 | 33 | 16 | P | 6 | -3 | 6 | 16 | 0 | -4 | 3 | 1 | 16 | -3F | 7 | 45 | P | 16 |
| -3F | 0 | 1 | 3 | 17 | -10 | 0 | 9 | P | 17 | -5 | -4F | -1 | 0 | 17 | 0 | 3 | 0 | 4 | 17 |
| -1 | -1 | 35 | 9 | 18 | -4F | -2 | 14 | 15 | 18 | 3 | 0 | 6 | 55 | 18 | P | 2 | 7 | 6 | 18 |
| 0 | 4 | 0 | -1 | 19 | 1 | 4 | 3 | 7 | 19 | -11F | 2 | 10 | 16 | 19 | -5 | -1F | 3 | 32 | 19 |
| -3 | P | 9 | 15 | 20 | 0 | 0 | 0 | 4 | 20 | -5 | 26 | 0 | 7 | 20 | F | 2 | 10 | 13 | 20 |
| -1 | 0 | 2 | 1 | 21 | -3 | 3 | 8 | 0 | 21 | P | -6 | 14 | 2 | 21 | 0 | 0 | 8 | 57 | 21 |
| 3 | 17 | 17 | 8 | 22 | 0 | -3F | P | 42 | 22 | 0 | 5 | 7 | 15 | 22 | -6 | 2 | 4 | 6 | 22 |
| 0 | 3 | -4 | 20 | 23 | -2 | -1 | 2 | 17 | 23 | -4 | 1 | F | P | 23 | 0 | 1 | 0 | -3F | 23 |
| -2 | 0 | 1F | 11 | 24 | -1 | 0 | 0 | 37 | 24 | -7F | 4 | 4 | 7 | 24 | -4F | 0 | 2 | 5 | 24 |
| 4 | 2 | 0 | 1 | 25 | -3F | P | 33 | 0 | 25 | -3 | 0 | 7 | 8 | 25 | 1 | P | -4 | 43 | 25 |
| 0 | 1 | -1 | 27 | 26 | -3 | 5 | 16 | 7 | 26 | -1 | P | 24 | 17 | 26 | -5 | -7 | 2F | 20 | 26 |
| P | -2 | 23 | 3 | 27 | 0 | 2 | -4F | 1 | 27 | -14 | -3 | 1 | 20 | 27 | 0 | 17 | 4 | 11 | 27 |
| -5 | 0 | 8 | 7 | 28 | -4 | 1 | 2 | 8 | 28 | -7 | 6 | -2F | 18 | 28 | 2 | 4 | 7 | 3 | 28 |
| 0 | 5 | 0 | 4 | 29 | -7 | 0 | 28 | P | 29 | -3F | 0 | 2 | 25 | 29 | P | 0 | 8 | 15 | 29 |
| -3 | -2 | P | 6 | 30 | P | -3 | 5 | 19 | 30 | 0 | 3 | 47 | 65 | 30 | -4 | 3 | 3 | 7 | 30 |
| -4F | 2 | 9 | 0 | 31 | 0 | 1 | 1 | 4 | 31 | P | -2 | P | 3 | 31 | 0 | 6 | P | 47 | 31 |
| -9 | -7 | 0 | 7 | 32 | -4 | -6 | 9 | 31 | 32 | -6 | 7 | 8 | 24 | 32 | -7 | -8 | 0 | 7 | 32 |
| 1 | 3 | 3 | 13 | 33 | 0 | -8 | 10 | 6 | 33 | 0 | -3 | 33 | 12 | 33 | -5F | 4 | -5 | 4 | 33 |
| 0 | P | 45 | 4 | 34 | F | 17 | 3 | -2F | 34 | -10F | 0 | P | -5F | 34 | -2 | -3 | 2 | 0 | 34 |
| -2 | 4 | 8 | 3 | 35 | -2F | 2 | 6 | 3 | 35 | -2 | -3F | 0 | 8 | 35 | 4 | -5 | 22 | 8 | 35 |
| -7 | -2F | 4 | 8 | 36 | 0 | -5 | 0 | 47 | 36 | -7 | -9 | -4 | 4 | 36 | -3 | 3 | 6 | 29 | 36 |
| 2 | -4 | 7 | P | 37 | -5 | P | 38 | 10 | 37 | F | 9 | 26 | 32 | 37 | 0 | -4F | 32 | 3 | 37 |
| -1 | 6 | 0 | 25 | 38 | 4 | 3 | -2 | 0 | 38 | -3 | -2F | 9 | 4 | 38 | -6F | 1 | 9 | 9 | 38 |
| P | 1 | 4 | 16 | 39 | -1F | 8 | 0 | 9 | 39 | P | 2 | 8 | 9 | 39 | -1 | 0 | -1F | -3 | 39 |
| -8 | -1 | P | 9 | 40 | 0 | 4 | P | 2 | 40 | F | 0 | 3 | 10 | 40 | 3 | 2 | 15 | 0 | 40 |
| 0 | 2 | 6 | 2 | 41 | 2 | F | 7 | -1 | 41 | -9 | -2 | -4F | 3 | 41 | P | -2 | 0 | 2 | 41 |
| -3F | 3 | -2 | 30 | 42 | 0 | -2 | 3 | 25 | 42 | -4 | 8 | 4 | 46 | 42 | 0 | 0 | 38 | 0 | 42 |
| -5 | 0 | 3 | 57 | 43 | F | -10 | 8 | 1 | 43 | -8 | -12 | 28 | 30 | 43 | -5 | -1 | P | -2 | 43 |
| -7 | 7 | 2 | 5 | 44 | 1 | 3 | -1 | 12 | 44 | -5F | P | 0 | 9 | 44 | -4 | 5 | 5 | 1 | 44 |
| -4 | -5 | 5 | P | 45 | F | 0 | 4 | P | 45 | -5 | -1 | 3 | 22 | 45 | 1 | 3 | 1 | P | 45 |
| F | 4 | -3 | 42 | 46 | 0 | 2 | 27 | 5 | 46 | -10 | 1 | 12 | P | 46 | -10 | 0 | 17 | 10 | 46 |
| CRUNCH | IN GRASP | HALF CLEAR | CLEAR | | CRUNCH | IN GRASP | HALF CLEAR | CLEAR | | CRUNCH | IN GRASP | HALF CLEAR | CLEAR | | CRUNCH | IN GRASP | HALF CLEAR | CLEAR | |
| UP MIDDLE | | | | OFF TACKLE | | | | | DRAW | | | | | WEAKSIDE TRAP | | | | | |

"INSIDE RUN CATEGORY"

FIG. 6

| RUNBACKS | | | | | | | | | |
|---|---|---|---|---|---|---|---|---|---|
| KICK OFF | | | R. B. K. O. | R. B INT. | R. B. PUNTS | R. B. BLOCK PUNT | R. B. F. G. | R. B. BLOCK F. G. | |
| 1 | 55 | 1 | 8 | 10 | F.C. | 10 | 10 | 0 | 1 |
| 2 | 60 | 2 | 41 | 30 | 18 | 7 | 20 | 15 | 2 |
| 3 | 70 | 3 | 20 | 6 | P | 30 | 1 | 19 | 3 |
| 4 | 49 | 4 | 19 | 11 | 42 | 10 | 30 | 1 | 4 |
| 5 | 56 | 5 | 7 | 7 | 12 | P | 19 | 9 | 5 |
| 6 | 38 | 6 | 21 | P | F.C. | 25 | P | 18 | 6 |
| 7 | 57 | 7 | 6 | 43 | 12F | 9 | 12 | 8 | 7 |
| 8 | ONSIDE KICK 12 | 8 | P | 8 | F.C. | 26F | 21 | P | 8 |
| 9 | 58 | 9 | 16 | 8F | 1 | 8 | 18 | 9 | 9 |
| 10 | 61 | 10 | 5 | 8 | F.C. F. | 11 | 8F | 82 | 10 |
| 11 | 59 | 11 | 102 | 12 | 16 | 41 | 10 | 2 | 11 |
| 12 | 71 | 12 | 22 | 41 | F.C. | 7 | 2 | 7 | 12 |
| 13 | 67 | 13 | 19 | 17 | 2 | 12 | 17 | 6 | 13 |
| 14 | 48 | 14 | 33 | 26 | -4 | 24 | 32 | 41 | 14 |
| 15 | 62 | 15 | 4 | 16 | 3 | P | P | 17 | 15 |
| 16 | ONSIDE FAIL 8 | 16 | 18 | 13 | FC | 13 | 9 | 3 | 16 |
| 17 | 66 | 17 | 23 | 5 | 92 | 6 | 14 | 50 | 17 |
| 18 | 56 | 18 | 52 | 90 | 2 | 12 | 22 | 5 | 18 |
| 19 | 70 | 19 | 15 | 15 | 4 | 32 | 14 | P | 19 |
| 20 | 54 | 20 | 17 | 25 | P | 5 | 8 | 4 | 20 |
| 21 | 69 | 21 | P | 9 | 15 | 14 | 41 | 26 | 21 |
| 22 | 55 | 22 | 14 | 14 | 5 | P | 15 | 16 | 22 |
| 23 | 65 | 23 | 24 | 4 | FC | 13 | 7 | 10 | 23 |
| 24 | 72 | 24 | 42 | 50 | 15 | 4 | 16 | 5 | 24 |
| 25 | 47 | 25 | 16 | 7 | 5 | 22 | 6 | 3 | 25 |
| 26 | 68 | 26 | 32 | 3 | F.C. | 16 | 13 | 4 | 26 |
| 27 | 39 | 27 | 13 | 19 | 4 | 9 | 16 | 11 | 27 |
| 28 | 64 | 28 | 43 | 21F | 14 | 14 | P | 6 | 28 |
| 29 | 53 | 29 | 25 | 13 | F.C. | 3 | 24 | 2 | 29 |
| 30 | 67 | 30 | 38 | 18 | 3 | 63 | 5 | 1 | 30 |
| 31 | 46 | 31 | 26 | 33 | 15 | 6 | 4 | 12 | 31 |
| 32 | 60 | 32 | 15 | 12 | 4 | 15 | 13 | 0 | 32 |
| 33 | 54 | 33 | 81 | 71 | 3 | 33 | 3 | 10 | 33 |
| 34 | 73 | 34 | 31 | 10 | 12 | 2 | 12 | 16F | 34 |
| 35 | 52 | 35 | 14 | 17 | P | 16 | -3 | 9 | 35 |
| 36 | 61 | 36 | 27 | P | 61 | 8 | 18 | 23 | 36 |
| 37 | 63 | 37 | 13 | 2 | 5 | 21 | 15 | 14 | 37 |
| 38 | 51 | 38 | 34F | 24 | 13 | 7 | 11 | 8 | 38 |
| 39 | 66 | 39 | 12 | 16 | 2 | 19 | 25 | 31 | 39 |
| 40 | 44 | 40 | 29 | 6 | 10 | 1. | 52 | 14 | 40 |
| 41 | 62 | 41 | P | 1 | F.C. | 18 | 5 | 15 | 41 |
| 42 | 76 | 42 | 24 | 22 | 33 | 15 | 15 | 7 | 42 |
| 43 | 64 | 43 | 11 | 15 | 5 | 0 | 4 | 32 | 43 |
| 44 | 29 | 44 | 2 | P | 4 | 35 | 27 | P | 44 |
| 45 | 50 | 45 | 30 | 20 | 1 | 17 | 40 | 21 | 45 |
| 46 | 65 | 46 | 10 | -3 | 25 | 20 | 10 | 16 | 46 |
| KICK OFF | | | R. B. K. O. | R.B. INT. | R. B. PUNTS | R. B. BLOCK PUNTS | R. B. F. G. | R. B. BLOCK F.G. | |
| RUNBACKS | | | | | | | | | |

FIG. 7

| PUNTS | | | | | | | | | | | | | | | | | | | | | | | | | |
|---|---|---|---|---|---|---|---|---|---|---|---|---|---|---|---|---|---|---|---|---|---|---|---|---|---|
| FAKE PUNT | | QUARTERBACK PUNT | | | FULLBACK PUNT | | | HALFBACK PUNT | | | WINGBACK PUNT | | | TAILBACK PUNT | | | SPECIALIST PUNT | | | SPREAD PUNT | | | TIGHT PUNT | | |
| CRUNCH | CLEAR | CRUNCH | | CLEAR | CRUNCH | | CLEAR | CRUNCH | | CLEAR | CRUNCH | | CLEAR | CRUNCH | | CLEAR | CRUNCH | | CLEAR | CRUNCH | | CLEAR | CRUNCH | | CLEAR |
| -5 | C8 | 1 | 16 | 50 | 1 | B | 57 | 1 | B | 50 | 1 | B | 73 | 1 | 12 | 61 | 1 | 12 | 50 | 1 | B | 40 | 1 | B | 56 |
| INC | 10I | 2 | B | 46 | 2 | -7F | P | 2 | -12F | 33 | 2 | B | 47 | 2 | B | 50 | 2 | B | 40 | 2 | 13 | 73 | 2 | 11 | 55 |
| C7 | INC | 3 | B | 32 | 3 | 20 | 49 | 3 | B | 48 | 3 | B | 40 | 3 | B | 40 | 3 | 30 | 32 | 3 | B | 50 | 3 | B | 44 |
| -4 | C25 | 4 | B | 40 | 4 | B | 32 | 4 | B | P | 4 | 40 | 55 | 4 | B | 42 | 4 | B | P | 4 | B | 32 | 4 | B | 45 |
| -20F | 2 | 5 | 14 | 47 | 5 | B | B | 5 | B | 62 | 5 | B | 48 | 5 | 13 | 28 | 5 | B | 41 | 5 | -14F | 41 | 5 | B | 49 |
| -3 | 0 | 6 | B | 51 | 6 | P | 58 | 6 | B | 40 | 6 | P | 67 | 6 | B | B | 6 | B | 68 | 6 | 16 | 44 | 6 | B | 33 |
| -9 | 12 | 7 | B | 34 | 7 | B | 48 | 7 | 33 | 47 | 7 | B | 41 | 7 | B | 41 | 7 | 40 | 59 | 7 | 12 | P | 7 | B | 54 |
| P | C14 | 8 | P | 48 | 8 | B | 73 | 8 | B | 51 | 8 | 14 | 54 | 8 | 30 | 44 | 8 | B | 51 | 8 | B | 33 | 8 | 32 | P |
| INC | 3 | 9 | 32 | 44 | 9 | 22 | 56 | 9 | P | 46 | 9 | B | 35 | 9 | B | 73 | 9 | 25 | 44 | 9 | P | 42 | 9 | B | 48 |
| -4 | C20 | 10 | B | P | 10 | 14 | 47 | 10 | B | 42 | 10 | B | 49 | 10 | P | 51 | 10 | -8F | 34 | 10 | B | 62 | 10 | B | B |
| -3I | P | 11 | B | 18 | 11 | B | 46 | 11 | B | 36 | 11 | B | 32 | 11 | B | 42 | 11 | B | 42 | 11 | -9F | B | 11 | B | 34 |
| -5 | 13 | 12 | B | 40 | 12 | B | 34 | 12 | 12 | 59 | 12 | B | 44 | 12 | B | 59 | 12 | B | 58 | 12 | B | 51 | 12 | B | 36 |
| INC | 31 | 13 | -8F | 49 | 13 | B | 45 | 13 | -11F | 45 | 13 | B | 53 | 13 | B | P | 13 | 24 | 40 | 13 | B | 41 | 13 | 41 | 67 |
| -13 | C15 | 14 | B | 73 | 14 | B | 18 | 14 | 20 | P | 14 | -8F | B | 14 | B | 44 | 14 | B | 35 | 14 | 26 | 45 | 14 | P | 47 |
| -10 | 9 | 15 | 20 | 42 | 15 | -8F | 59 | 15 | B | 38 | 15 | B | 52 | 15 | B | 43 | 15 | B | 41 | 15 | B | 40 | 15 | B | 41 |
| 7I | C9 | 16 | B | 52 | 16 | 24 | 46 | 16 | 13 | 52 | 16 | B | P | 16 | B | 40 | 16 | 13 | P | 16 | B | 35 | 16 | -8F | 57 |
| -17F | 14 | 17 | B | 35 | 17 | B | 62 | 17 | 41 | 44 | 17 | B | 48 | 17 | -7F | 44 | 17 | B | 52 | 17 | B | 43 | 17 | 24 | 49 |
| -4 | 28 | 18 | 3 | 44 | 18 | B | 55 | 18 | 21 | 73 | 18 | B | 56 | 18 | B | 33 | 18 | B | 45 | 18 | B | P | 18 | B | 46 |
| -9 | P | 19 | P | 49 | 19 | B | 35 | 19 | B | 44 | 19 | B | 51 | 19 | B | 52 | 19 | B | 64 | 19 | B | 52 | 19 | B | 44 |
| INC | 8 | 20 | B | 37 | 20 | 41 | 42 | 20 | B | 45 | 20 | B | 18 | 20 | 23 | 45 | 20 | B | 49 | 20 | B | 41 | 20 | B | 45 |
| C9 | 27 | 21 | B | 53 | 21 | B | 45 | 21 | B | 41 | 21 | B | 50 | 21 | B | 49 | 21 | B | 57 | 21 | B | 45 | 21 | B | 38 |
| INC | 1 | 22 | -12F | 62 | 22 | 30 | P | 22 | B | 53 | 22 | B | 44 | 22 | B | 34 | 22 | -10F | 42 | 22 | B | 29 | 22 | 15 | 18 |
| -9F | C8 | 23 | B | B | 23 | B | 40 | 23 | 23 | 49 | 23 | P | 45 | 23 | B | 45 | 23 | B | 46 | 23 | -11F | 18 | 23 | B | 53 |
| -6I | 15 | 24 | 40 | 46 | 24 | -12F | 54 | 24 | B | 46 | 24 | B | 62 | 24 | B | 58 | 24 | B | 73 | 24 | 41 | 65 | 24 | 22 | 37 |
| 0 | 33 | 25 | B | 28 | 25 | B | 28 | 25 | B | 40 | 25 | -9F | 34 | 25 | 14 | 46 | 25 | P | 43 | 25 | B | 53 | 25 | B | 44 |
| -10F | 7 | 26 | 22 | 54 | 26 | B | 44 | 26 | B | 54 | 26 | 15 | 45 | 26 | P | 35 | 26 | B | 53 | 26 | B | 59 | 26 | -9F | 41 |
| -3 | 2 | 27 | B | 45 | 27 | B | 65 | 27 | B | P | 27 | B | 46 | 27 | 40 | P | 27 | B | 48 | 27 | B | 46 | 27 | B | 43 |
| -9 | INC | 28 | P | P | 28 | B | 37 | 28 | P | 64 | 28 | B | 37 | 28 | B | 46 | 28 | B | 49 | 28 | B | 54 | 28 | P | 52 |
| -8 | 16 | 29 | B | 64 | 29 | B | 45 | 29 | B | 34 | 29 | B | P | 29 | B | 63 | 29 | B | 37 | 29 | B | 43 | 29 | B | 64 |
| P | 7 | 30 | B | 45 | 30 | B | 38 | 30 | B | 18 | 30 | -12F | 44 | 30 | -9F | 41 | 30 | 14 | 54 | 30 | B | P | 30 | 16 | P |
| INC | 45 | 31 | B | 55 | 31 | P | 43 | 31 | B | 58 | 31 | 26 | 40 | 31 | B | 53 | 31 | -12F | 45 | 31 | B | 49 | 31 | B | 40 |
| -8 | INC | 32 | 13 | 44 | 32 | B | 49 | 32 | B | B | 32 | B | 44 | 32 | B | 18 | 32 | B | 44 | 32 | B | 37 | 32 | B | 58 |
| -4 | 3 | 33 | -13F | 41 | 33 | 15 | 40 | 33 | -10F | 43 | 33 | B | 28 | 33 | 21 | 45 | 33 | 21 | 45 | 33 | B | 58 | 33 | B | 45 |
| 6I | C24 | 34 | B | 48 | 34 | B | 53 | 34 | B | 48 | 34 | B | 43 | 34 | B | 57 | 34 | B | 41 | 34 | P | 44 | 34 | -11F | 59 |
| -2 | C10 | 35 | B | 43 | 35 | B | 48 | 35 | B | 57 | 35 | 13 | 42 | 35 | B | P | 35 | B | 46 | 35 | B | 55 | 35 | B | 46 |
| INC | 4 | 36 | B | 59 | 36 | B | 42 | 36 | B | 67 | 36 | 23 | 59 | 36 | B | 37 | 36 | B | 38 | 36 | B | 68 | 36 | B | 51 |
| -7 | 24 | 37 | B | 67 | 37 | -13F | 41 | 37 | P | 28 | 37 | B | 39 | 37 | B | 54 | 37 | B | 47 | 37 | 32 | 44 | 37 | B | 40 |
| -8F | 6 | 38 | B | 39 | 38 | B | 52 | 38 | B | 45 | 38 | B | 65 | 38 | -12F | 49 | 38 | P | 55 | 38 | B | 45 | 38 | B | 41 |
| P | C12 | 39 | -9F | 42 | 39 | B | 44 | 39 | B | 49 | 39 | 22 | 42 | 39 | B | 68 | 39 | B | B | 39 | B | 48 | 39 | 20 | 50 |
| -12 | 23 | 40 | B | 58 | 40 | B | 67 | 40 | 14 | 40 | 40 | -14F | 58 | 40 | B | 38 | 40 | B | P | 40 | 22 | 57 | 40 | B | P |
| INC | C13 | 41 | 23 | P | 41 | B | 44 | 41 | B | 39 | 41 | B | 40 | 41 | B | 48 | 41 | -14F | 48 | 41 | 20 | 38 | 41 | P | 62 |
| -6 | 18 | 42 | B | 44 | 42 | P | 41 | 42 | B | 56 | 42 | 30 | P | 42 | 20 | 55 | 42 | B | 56 | 42 | -12F | 46 | 42 | B | 48 |
| 12I | P | 43 | B | 41 | 13 | B | 51 | 43 | -14F | 41 | 43 | B | 57 | 43 | P | 48 | 43 | B | 18 | 43 | B | 49 | 43 | -13F | 73 |
| -10 | C22 | 44 | B | 57 | 44 | 11 | P | 44 | B | 44 | 44 | B | 41 | 44 | -13F | 44 | 44 | B | 61 | 44 | B | 47 | 44 | B | 29 |
| INC | 5 | 45 | B | 40 | 45 | B | 40 | 45 | B | 55 | 45 | B | 56 | 45 | B | 56 | 45 | P | 28 | 45 | P | 56 | 45 | B | 42 |
| -1 | INC | 46 | B | 56 | 46 | B | 50 | 46 | B | 42 | 46 | P | 40 | 46 | B | 47 | 46 | B | 44 | 46 | B | 48 | 46 | B | 43 |
| CRUNCH | CLEAR | CRUNCH | | CLEAR | CRUNCH | | CLEAR | CRUNCH | | CLEAR | CRUNCH | | CLEAR | CRUNCH | | CLEAR | CRUNCH | | CLEAR | CRUNCH | | CLEAR | CRUNCH | | CLEAR |
| FAKE PUNT | | QUARTERBACK PUNT | | | FULLBACK PUNT | | | HALFBACK PUNT | | | WINGBACK PUNT | | | TAILBACK PUNT | | | SPECIALIST PUNT | | | SPREAD PUNT | | | TIGHT PUNT | | |
| PUNTS | | | | | | | | | | | | | | | | | | | | | | | | | |

FIG. 8

FIELD GOALS

| | FAKE F.G. | | QUARTERBACK F.G. | | | FULLBACK F.G. | | | HALFBACK F.G. | | | WINGBACK F.G. | | | TAILBACK F.G. | | | SPECIALIST F.G. | | | |
|---|---|---|---|---|---|---|---|---|---|---|---|---|---|---|---|---|---|---|---|---|---|
| | CRUNCH | CLEAR | | CRUNCH | CLEAR | | CRUNCH | CLEAR | | CRUNCH | CLEAR | | CRUNCH | CLEAR | | CRUNCH | CLEAR | | CRUNCH | CLEAR | |
| 1 | -10F | C8 | 1 | B | 34 | 1 | B | 41 | 1 | 19 | 38 | 1 | B | 46 | 1 | 27 | 47 | 1 | B | 48 | 1 |
| 2 | -3 | 1 | 2 | B | 24 | 2 | B | 34 | 2 | B | 51 | 2 | B | 50 | 2 | B | 48 | 2 | B | 34 | 2 |
| 3 | -9 | 17 | 3 | P | 46 | 3 | B | 42 | 3 | 27 | 20 | 3 | B | 47 | 3 | B | 34 | 3 | 32 | 48 | 3 |
| 4 | INC | 4 | 4 | B | 44 | 4 | P | 53 | 4 | B | P | 4 | B | 51 | 4 | -6F | 49 | 4 | B | 49 | 4 |
| 5 | -4 | C9 | 5 | 24 | 22 | 5 | B | 40 | 5 | B | 38 | 5 | 32 | 45 | 5 | B | P | 5 | 20 | 36 | 5 |
| 6 | -6F | 2 | 6 | B | 46 | 6 | B | 34 | 6 | B | 53 | 6 | B | 36 | 6 | B | 50 | 6 | B | 31 | 6 |
| 7 | P | 19 | 7 | -8F | 42 | 7 | 24 | 43 | 7 | P | 42 | 7 | B | 34 | 7 | B | 35 | 7 | 21 | 32 | 7 |
| 8 | -5 | P | 8 | B | 49 | 8 | B | 20 | 8 | 25 | 39 | 8 | B | P | 8 | B | 51 | 8 | B | 50 | 8 |
| 9 | INC | 22 | 9 | P | 45 | 9 | B | 49 | 9 | B | 55 | 9 | B | 43 | 9 | 25 | 36 | 9 | P | 53 | 9 |
| 10 | -6 | C16 | 10 | B | 44 | 10 | B | 35 | 10 | B | 41 | 10 | -7F | 44 | 10 | B | 34 | 10 | B | 20 | 10 |
| 11 | -4 | 16 | 11 | B | 38 | 11 | -8F | 44 | 11 | B | 40 | 11 | B | 35 | 11 | B | 36 | 11 | B | 51 | 11 |
| 12 | -5 | 3 | 12 | B | 60 | 12 | B | 49 | 12 | -9F | 57 | 12 | B | 38 | 12 | B | P | 12 | B | 36 | 12 |
| 13 | INC | C28 | 13 | B | 32 | 13 | 22 | 39 | 13 | B | 42 | 13 | B | 53 | 13 | B | 20 | 13 | B | 47 | 13 |
| 14 | -13 | O | 14 | B | 37 | 14 | B | 48 | 14 | 23 | 22 | 14 | B | 42 | 14 | B | 53 | 14 | 23 | 44 | 14 |
| 15 | -10 | INC | 15 | B | 57 | 15 | P | 50 | 15 | B | P | 15 | B | B | 15 | 32 | 37 | 15 | B | 46 | 15 |
| 16 | -8F | 26 | 16 | B | 43 | 16 | B | 36 | 16 | B | 60 | 16 | B | 55 | 16 | B | 46 | 16 | B | P | 16 |
| 17 | -5 | P | 17 | -10F | B | 17 | 21 | 45 | 17 | B | 34 | 17 | P | 32 | 17 | 23 | 63 | 17 | B | 30 | 17 |
| 18 | -4 | 14 | 18 | B | 36 | 18 | B | 51 | 18 | B | 43 | 18 | B | 34 | 18 | B | 38 | 18 | B | 37 | 18 |
| 19 | -8F | -8 | 19 | 19 | 31 | 19 | B | 22 | 19 | B | 37 | 19 | B | 57 | 19 | B | 44 | 19 | B | 53 | 19 |
| 20 | INC | 12 | 20 | B | P | 20 | B | P | 20 | 28 | 53 | 20 | 27 | 42 | 20 | B | 55 | 20 | B | 42 | 20 |
| 21 | -12 | 3 | 21 | 21 | 63 | 21 | B | 38 | 21 | B | 48 | 21 | B | P | 21 | -7F | 42 | 21 | B | 33 | 21 |
| 22 | -4I | 16I | 22 | B | 42 | 22 | 19 | 24 | 22 | -13F | 36 | 22 | B | 42 | 22 | B | 60 | 22 | P | 38 | 22 |
| 23 | -3 | 4 | 23 | B | 36 | 23 | B | 42 | 23 | B | 45 | 23 | -8F | 20 | 23 | B | 38 | 23 | -6F | P | 23 |
| 24 | P | C24 | 24 | B | 20 | 24 | B | 38 | 24 | B | 35 | 24 | B | 44 | 24 | B | 31 | 24 | B | 46 | 24 |
| 25 | C8 | C-15 | 25 | 32 | 47 | 25 | B | 48 | 25 | B | 44 | 25 | B | 22 | 25 | B | 38 | 25 | B | B | 25 |
| 26 | INC | P | 26 | B | 53 | 26 | 26 | 36 | 26 | B | 36 | 26 | 25 | 36 | 26 | B | 49 | 26 | B | 29 | 26 |
| 27 | 5 | 5 | 27 | B | 35 | 27 | B | 37 | 27 | P | 63 | 27 | B | 53 | 27 | B | 32 | 27 | B | 45 | 27 |
| 28 | -2 | C17 | 28 | B | 55 | 28 | -6F | 47 | 28 | B | 33 | 28 | 24 | 24 | 28 | P | 57 | 28 | B | 63 | 28 |
| 29 | INC | INC | 29 | 22 | 48 | 29 | B | 42 | 29 | B | 50 | 29 | B | 46 | 29 | -9F | 46 | 29 | P | 38 | 29 |
| 30 | -1 | C15 | 30 | P | 53 | 30 | B | 26 | 30 | B | 46 | 30 | -6F | 38 | 30 | B | 22 | 30 | B | 44 | 30 |
| 31 | 6I | C22 | 31 | -14F | 48 | 31 | B | 46 | 31 | B | 49 | 31 | P | 37 | 31 | 19 | 45 | 31 | B | 38 | 31 |
| 32 | F | 6 | 32 | B | P | 32 | B | 27 | 32 | 20 | 38 | 32 | B | P | 32 | B | B | 32 | 25 | 27 | 32 |
| 33 | -7 | 8 | 33 | B | 42 | 33 | B | 46 | 33 | B | B | 33 | 22 | 48 | 33 | 21 | 24 | 33 | B | 60 | 33 |
| 34 | 4I | C22 | 34 | B | 49 | 34 | B | 29 | 34 | B | 32 | 34 | B | 49 | 34 | B | 44 | 34 | 19 | 43 | 34 |
| 35 | O | INC | 35 | 25 | 26 | 35 | -10F | P | 35 | B | 49 | 35 | B | 26 | 35 | -12F | 48 | 35 | B | 26 | 35 |
| 36 | P | 7 | 36 | B | 51 | 36 | B | 38 | 36 | B | 24 | 36 | B | 27 | 36 | 20 | P | 36 | B | 24 | 36 |
| 37 | -8 | 29 | 37 | -6F | 38 | 37 | B | 30 | 37 | B | 48 | 37 | -9F | 38 | 37 | B | 43 | 37 | B | P | 37 |
| 38 | INC | C25 | 38 | B | 27 | 38 | P | B | 38 | -6F | 42 | 38 | B | 39 | 38 | B | 26 | 38 | B | 42 | 38 |
| 39 | 17I | 8 | 39 | B | P | 39 | 32 | 31 | 39 | B | 26 | 39 | B | 49 | 39 | P | 39 | 39 | -12F | 22 | 39 |
| 40 | -2 | INC | 40 | B | 50 | 40 | B | 44 | 40 | B | 29 | 40 | B | 29 | 40 | B | 27 | 40 | B | 39 | 40 |
| 41 | -1 | 9 | 41 | B | 41 | 41 | 20 | 63 | 41 | P | 44 | 41 | 19 | 60 | 41 | B | 42 | 41 | 27 | 49 | 41 |
| 42 | -9 | 10 | 42 | B | 29 | 42 | B | 55 | 42 | B | 27 | 42 | P | 30 | 42 | B | 29 | 42 | B | 57 | 42 |
| 43 | INC | 32 | 43 | B | 38 | 43 | B | 53 | 43 | 36 | 47 | 43 | B | 40 | 43 | B | 42 | 43 | -10F | 42 | 43 |
| 44 | 15I | 11 | 44 | 27 | 30 | 44 | B | 57 | 44 | B | 30 | 44 | B | 63 | 44 | B | 53 | 44 | B | 55 | 44 |
| 45 | -10 | C7 | 45 | B | 40 | 45 | -6F | P | 45 | -7F | P | 45 | B | 41 | 45 | B | 41 | 45 | -8F | 41 | 45 |
| 46 | INC | 38 | 46 | B | 39 | 46 | B | 60 | 46 | B | 46 | 46 | 20 | 48 | 46 | P | 40 | 46 | B | 40 | 46 |
| | CRUNCH | CLEAR | CRUNCH | | CLEAR | CRUNCH | | CLEAR | CRUNCH | | CLEAR | CRUNCH | | CLEAR | CRUNCH | | CLEAR | CRUNCH | | CLEAR | |
| | FAKE F.G. | | QUARTERBACK F.G. | | | FULLBACK F.G. | | | HALFBACK F.G. | | | WINGBACK F.G. | | | TAILBACK F.G. | | | SPECIALIST F.G. | | | |

FIELD GOALS

FIG. 9

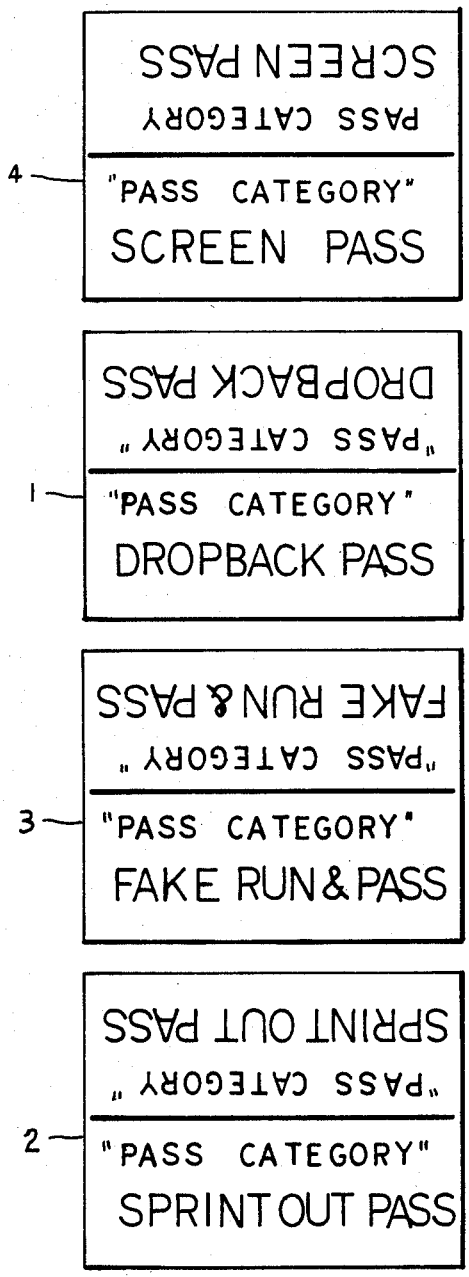
FIG. 10
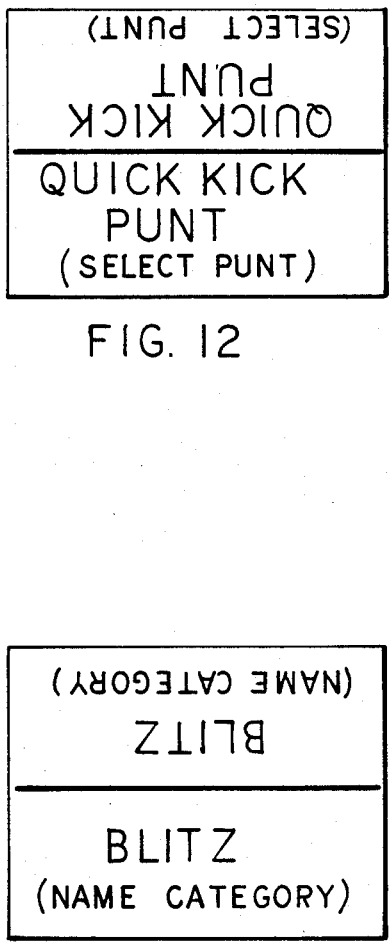
FIG. 11
FIG. 12

QUARTERBACK GAME

BACKGROUND OF THE INVENTION

This invention is in part the result of research and data collected in the course of 18 years as a quarterback, offensive coordinator and quarterback coach in the National Football League.

This invention relates to apparatuses and methods for simulating professional football. More in particular, the invention relates to board games and computerized games wherein professional football is simulated.

Attempts at simulating football can be traced into the 19th Century. U.S. Pat. No. 563,767 depicts a board game having a gridiron representation and a spinner.

One of the striking features of football history is the number of changes that have ensued over the years. This is true not only in the actual live performance of the American brand of football, but also in the various manifestations of simulations of football.

U.S. Pat. No. 593,512 discloses a gridiron representation as well as a spinner indicating the amount of yardage gained. This game employs toy players propelling toy balls on a toy field. Actual complicated modern football plays are not possible with this game.

U.S. Pat. No. 795,822 discloses a gridiron in combination with several spinners. Players are moveable upon a board wherein the players are connected by links or bonds. This game is similar in some respects to football, but is not intended to simulate football closely. Modern football may not be played with this game.

U.S. Pat. No. 817,191 discloses a rugby card game. There are 66 playing cards which are divided into 11 suits of 6. Each card contains 5 plays; kick-off, punt, goal after touchdown, goal from field and rushing. This is not prior art, but is interesting as an attempt to play a sport with specialized cards.

U.S. Pat. No. 1,273,675 contains a gridiron representation as well as a spinner. The play results are determined in a completely random fashion. As modern football is largely dependent upon a good defense guessing what the offense will do, less randomness or arbitrariness is needed for accurate football simulation.

U.S. Pat. No. 1,467,912 has a gridiron representation as well as a very complicated spinner. Team players are left with no discretion as to which plays are chosen or the results.

U.S. Pat. No. 1,838,398 is a football game apparatus having a gridiron representation as well as 7 spinners attached thereto. In this game a player is allowed to choose his offense play, announce it and then spin for the result. There is no room for the defensive player to "read the offense".

U.S. Pat. No. 1,992,475 is a football game in combination with cards. The cards in this game pertain to a particular play and then have the face of the card divided into zones corresponding to the zones on the field. (See claim 1) This game is an offensive biased quarterback game wherein no defensive input occurs. In contrast, success of live football plays is largely dependent upon the defense guessing what the offense will do.

U.S. Pat. No. 2,049,284 is a football game containing a gridiron representation having an elaborate dice, tumbler annexed thereto. There is a chart of plays which is used with this game. The chart gives 88 variations of play through each of seven line positions or 616 variations of line plays on a simple chart of 11 chances. In this game an offensive member names his play, rolls the dice and consults the chart for yardage. The defense player then rolls dice to obtain yardage which is then subtracted from the offensive yardage and a new line of scrimmage is established. Actual live football involves much less chance and offensive teams do not tell defensive teams what their plays are before yardage is gained or lost.

U.S. Pat. No. 3,103,361 is a football board game using play selecting cards. There are offensive cards as well as defensive cards each of which is separate and apart from the other. In this game the defensive player first chooses his defensive card. The offense then chooses his card and discloses his choice. The defense member aligns his card containing graphic representations with the gridiron and locates the play result on the card. Live football is played by the offense choosing a play and the defense trying to guess what that play is.

U.S. Pat. No. 3,526,403 is a football board game having result charts. Cards are used with this game, but they are regular poker-type cards.

U.S. Pat. No. 3,995,863 teaches a football board game having a gridiron representation having associated, complicated moveable parts located thereon. This patent exemplifies the more complicated extreme of football board games.

U.S. Pat. No. 4,003,580 is a football board game having a gridiron representation. In this game, as can be seen from FIG. 2, the defense tries to guess what the offense is doing. Playing cards are used in this game and play results are determined by a set of cards called "down" cards. The offensive player chooses one of two plays and the defense responds by guessing which of the two plays the offense chose. Modern football has a great many more plays than running or passing and in addition, realistic defensive strategies involve degrees of success in guessing offensive strategies. A football game simulator is needed wherein the full panoply of professional plays are brought into the game strategy. Means are needed to assess the degree of success in guessing the offensive strategy. Simple cards are needed designating plays. Moreover a game is needed wherein the possible play result combinations do not decrease as the game proceeds. As is often the case in professional football, an offense may want to try the same play over and over again if it works. A game is needed where this is possible.

U.S. Pat. No. 4,094,509 is a football board game having a gridiron representation and a play result chart. Dice are used extensively as well as offensive play cards. In this game, with the exception of kickoff, the offensive player must announce his play in advance to rolling dice. Defensive guessing is absent in this game.

U.S. Pat. No. 4,173,346 is a football board game having playing cards and dice. There is little room in this game for offensive strategies and defensive guessing. Dice are used in unique ways to announce plays and results.

U.S. Pat. No. 4,168,834 is a football board game which is pocket size and uses offense and defense cards. The offense and defense cards are different from each other. Defensive guessing of the offense is limited to setting up a defense which is felt to be sufficient. There is no chance for the defense to guess what the offense is going to do.

Many problems exist in past attempts to accurately simulate professional football. A football simulation is needed which satisfies the skilled technician of professional football as well as entertains and teaches central concepts to neophytes. A game is needed which involves players to the point of setting up strategies, second guessing strategies, giving credit to defense players for varying degrees of success in second guessing, obtaining play results based only in part on randomness or the "breaks" of the game. In short, an accurate simulation of NFL football is needed.

SUMMARY OF THE INVENTION

The present invention solves all the problems in the prior art.

The invention is a board game simulating professional football. It is referred to as "The Quarterback Game" because the game is played from the perspective of those participants of a real professional football game who decide which plays, both offensive and defensive, will be used.

The apparatus of the invention is simple and straightforward. There is a gridiron representation, FIG. 1, having a moveable line of scrimmage piece, and a moveable 10 yard marker piece. (not shown) There are two sets of cards representing offensive plays, FIGS. 10–16. The two decks are identical. There is an additional special defense card designating the blitz. There are six probability result charts, FIGS. 4–9. Each chart represents a play category. The play categories are: Pass category, FIG. 4; Outside Run category, FIG. 5; Inside Run category, FIG. 6; Kickoff category, FIG. 7; Runback category, FIG. 7; Punt category, FIG. 8, and Field Goal category, FIG. 9. In the preferred embodiment, charts are set up as grids having vertical and horizontal columns. Each card/play of the offensive play deck is set out on each chart and has a number of vertical columns set out under each play within a category. In addition to each play having a set of vertical columns, there are up to 46 horizontal segments to each column. Each segment of each vertical column contains a probable play result. The results within each segment or section is based upon real football games averaged out over a course of one season. The vertical columns corresponding to each card within a category represent varying degrees of success in the defense attempting to guess and estimate which play the offense will use. The horizontal segments to each vertical column is represented by a number. As many as 46 segments to each vertical column is present. For any given vertical column, there are as many as 46 different results. There are 4,018 possible play results which can occur in the game.

The game provides a random number selection means, FIG. 2, which provides an element of chance, wherein the resultant number refers to the horizontal line on the chart. The various charts have many designations for play results including yards gained, yards lost, incomplete passes, and penalties. A random penalty selector is provided, FIG. 3, representing the uncertainty and arbitrariness of referees in professional football games. There is also provided a random selector for extra points, also FIG. 3. Extra points in professional football are attempted after a touchdown has been obtained. The random selector is based upon professional probabilities of making the extra point.

In addition to the apparatus of the invention, the invention also comprises the method of playing with the apparatus. Two teams are selected. A coin is tossed to determine which team will receive and which team will kick off. The team kicking off, i.e., defense, operates the random number selector, FIG. 2, and looks up the results under the kick off column on the kick off chart, FIG. 7. The yardage of the kick is noted. The team receiving, i.e., offense, operates the random number selector, FIG. 2, and looks up the results under the runback of kick offs category, FIG. 7. Manipulations of the yardage of the kick and the runback yardage will determine where the line of scrimmage will be for the first down of the offense team. The 10 yard line marker, not shown, is then set for the offense. From here on out, the game is played such that the offense will choose a card unbeknownst to the defense, and the defense will usually have several opportunities to try to guess what the offense will be playing. The degree of success of the defense in guessing what the offense will do, determines what vertical column under the offense play category will be used for the result. Once the attempted matching of plays has occurred, the offense will manipulate the random number selector, FIG. 3, to obtain a horizontal segment of the vertical column and thus the play result. If the probability chart refers to a penalty, then the random selector of penalties, FIG. 3, is used to determine the extent of the penalties. If there is a touchdown and an extra point attempt, a random selector for points, FIG. 3, is manipulated to obtain the results for that. The game is set up to be played over the course of one hour as in real football. Timeouts are designated which may be used at certain designated points in time. The game has been designed to reflect real professional football situations and care has been taken to design into the game just the right amount of chance corresponding to the similar amounts of chance in real professional football.

Accordingly, it is an object of this invention to provide a professional football simulator capable of being used as both an entertainment game as well as a teaching device.

It is another object of this invention to provide an improved football board game.

It is another object of this invention to solve the problems in the prior art.

It is still another object of this invention to provide as realistic as possible, a football game wherein actual professional football results and probabilities have been designed into the game.

It is yet another object of this invention to provide a professional football game simulator wherein the participants are put to the task of having to think and behave as their counterparts in actual live professional settings.

These and other further objects of this invention will become apparent from the foregoing and ongoing specification including the claims and drawings.

BRIEF DESCRIPTION OF THE DRAWINGS

FIG. 4 is a Pass Category Result Chart.

FIG. 5 is a Outside Run Category Result Chart.

FIG. 6 is an Inside Run Category Result Chart.

FIG. 7 is a Kickoff/Runback Category Result Chart.

FIG. 8 is a Punt Result Chart.

FIG. 9 is a Field Goal Result Chart.

FIG. 10 shows the cards in the Pass Category.

FIG. 11 shows the Blitz card.

FIG. 12 shows the Quick Kick card.

DESCRIPTION OF THE PREFERRED EMBODIMENT

The apparatus of the invention is simple and straight forward. The drawings refer to an embodiment typifying a board game set up and reference will be made to these drawings in explaining the invention. Notwithstanding, the following description having references to board game illustrations, the invention contains principles generic to any such embodiment and the best modes for carrying out the invention are manifold. References will be made when possible to best mode equivalents to illustrations as well as to spelling out means plus function language in the claims.

Figure 1:
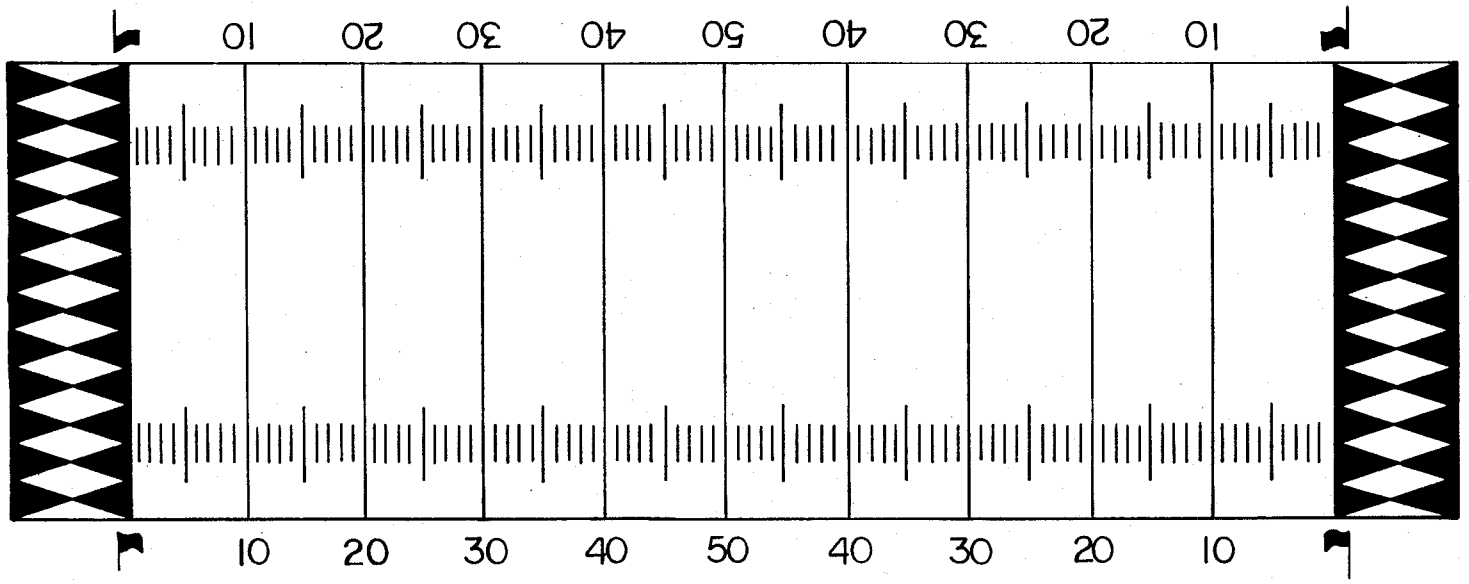
FIG. 1 is a diagrammatic depiction of the gridiron.

Referring to the various drawings present, board game embodiment is readily apparent. There is a gridiron representation simulating a professional football field, FIG. 1. Moveable pieces are provided to represent the line of scrimmage and the 10 yard marker, not shown. There are two decks of offensive play cards, FIGS. 10–16. The two decks are identical. The cards are set up in categories representing broad plays and within each category are cards representing the various possible plays within each broad category. Referring to FIGS. 10–16 the categories are shown with each individual card within each category being represented. The categories may be thought of as suits for the card deck. Each suit has its own individual cards representing individual plays within the suits or categories.

Figure 17:
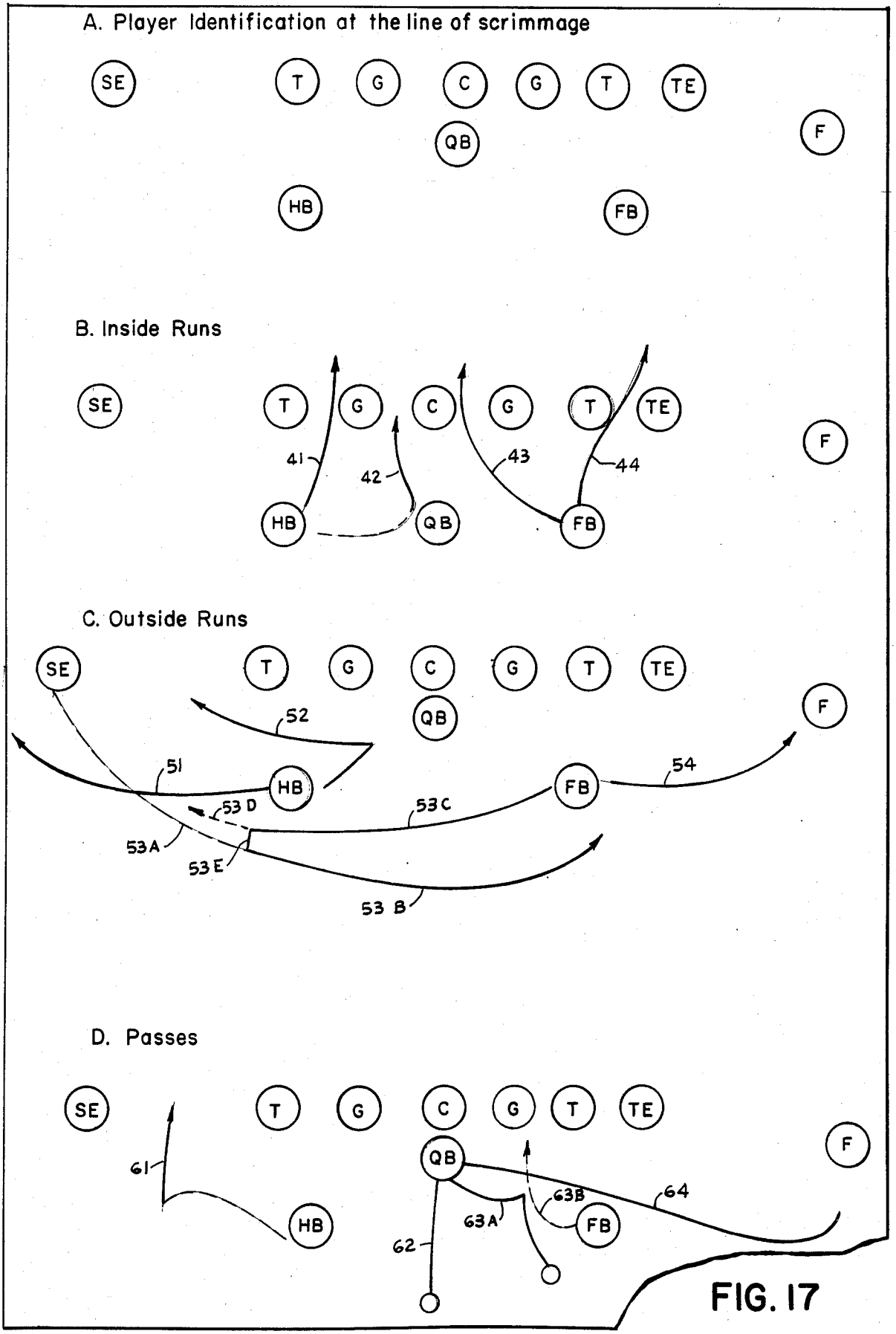
FIG. 17 is a diagram of various plays.

There are four cards representing four types of passes under the pass category, FIG. 10. There is the dropback pass 1. FIG. 17 shows what is meant by a dropback pass. There is a sprint out pass card 2 which is explained by FIG. 17. There is the fake run and pass card 3 which is explained by FIG. 17, and there is the screen pass card explained by FIG. 17.

Figure 14:
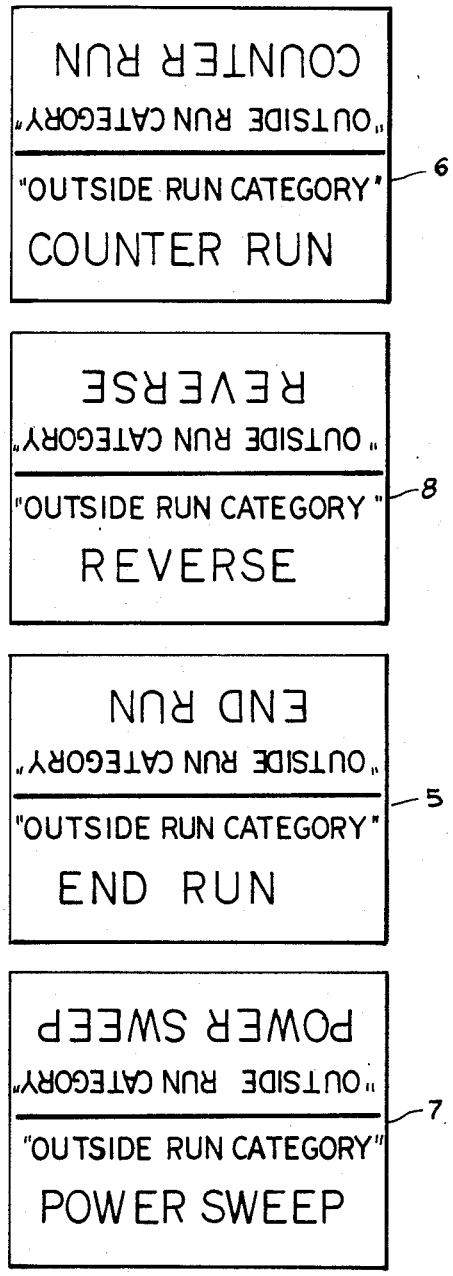
FIG. 14 shows the Outside Run Category cards.

In addition to the four types of passes available to the offense, there is the outside run category, FIG. 14, which also has four cards or plays. There is the end run card 5 which is explained or made apparent by FIG. 17. There is the counter run card 6 which is explained by FIG. 17. There is the power sweep card 7 explained by FIG. 17. There is the reverse card 8 explained by FIG. 17.

Figure 13:
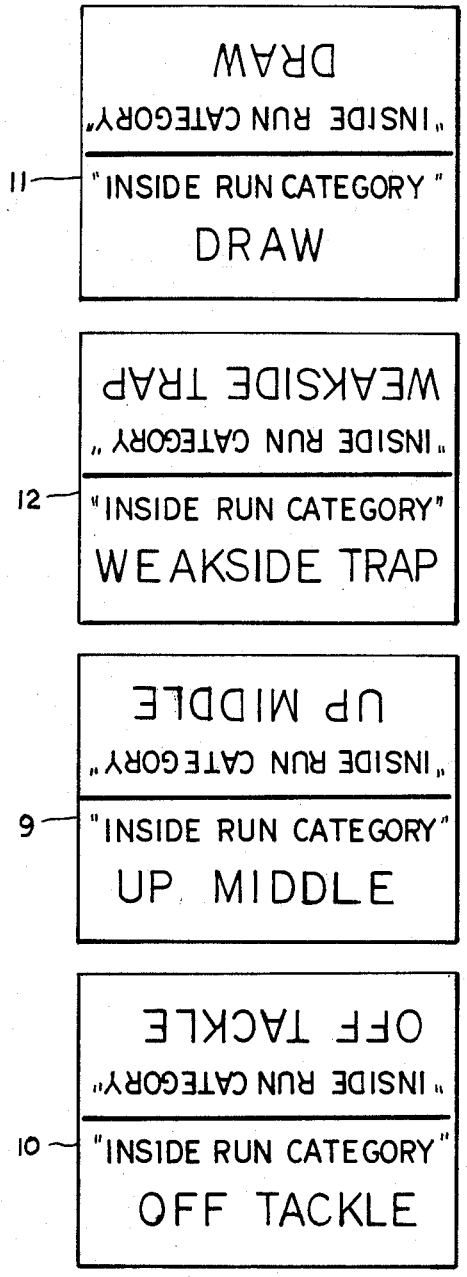
FIG. 13 shows the Inside Run Category cards.

The offense also has available in addition to outside run type plays, inside run type plays, FIG. 13. There is an up the middle card 9 explained by FIG. 17. There is an off tackle card 10 explained by FIG. 17. There is a draw card 11 explained by FIG. 17, and there is a weakside trap card 12 explained by FIG. 17.

Figure 15:
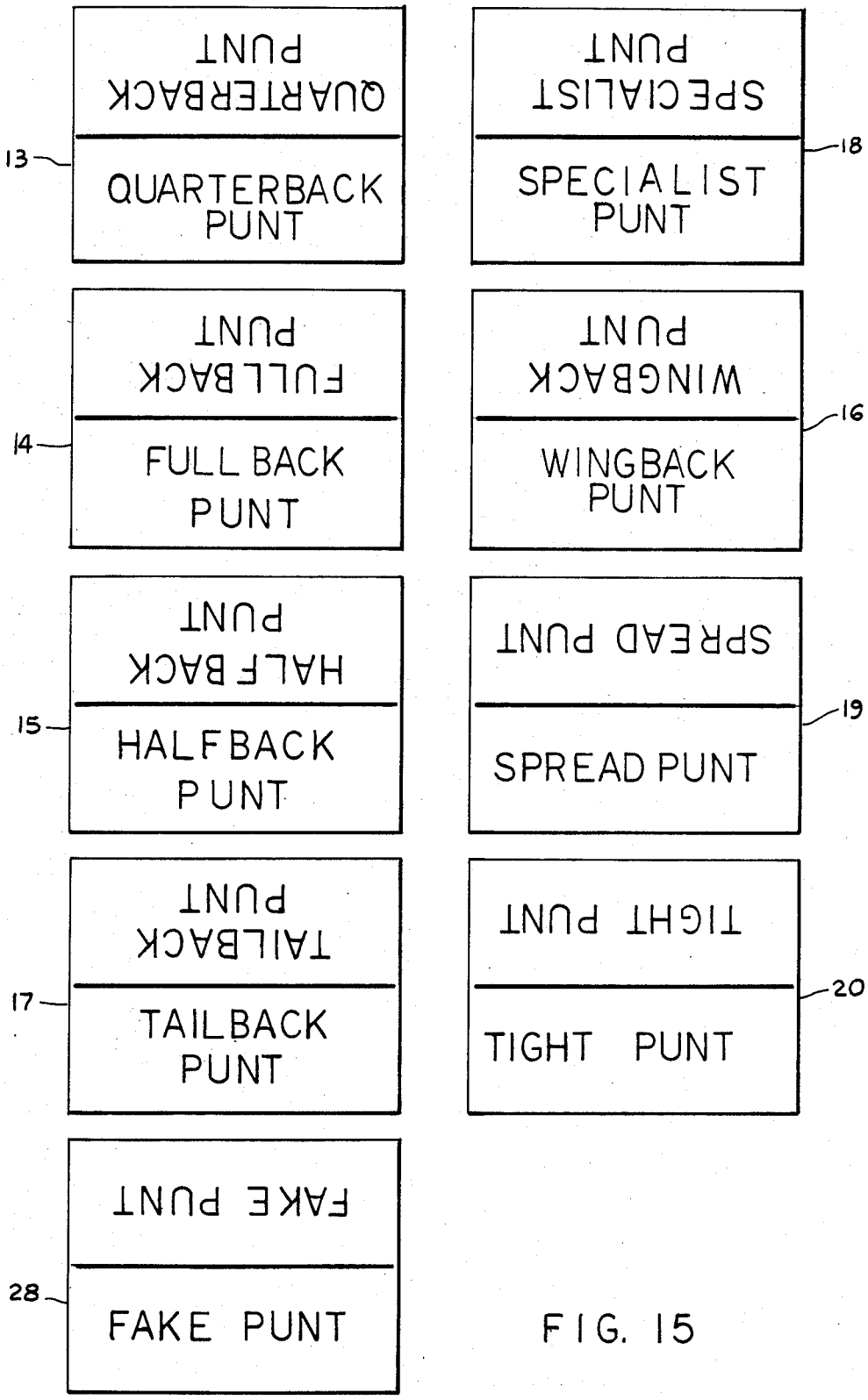
FIG. 15 shows the Punt cards.

In addition to the passing and running categories, there is the punting category representing the full array of possible punts, FIG. 15. There is: a quarterback punt card 13; a fullback punt card 14; a halfback punt card 15; a wingback punt card 16; a tailback punt card 17; a specialist punt card 18; a spread punt card 19; and a tight punt card 20.

Figure 16:
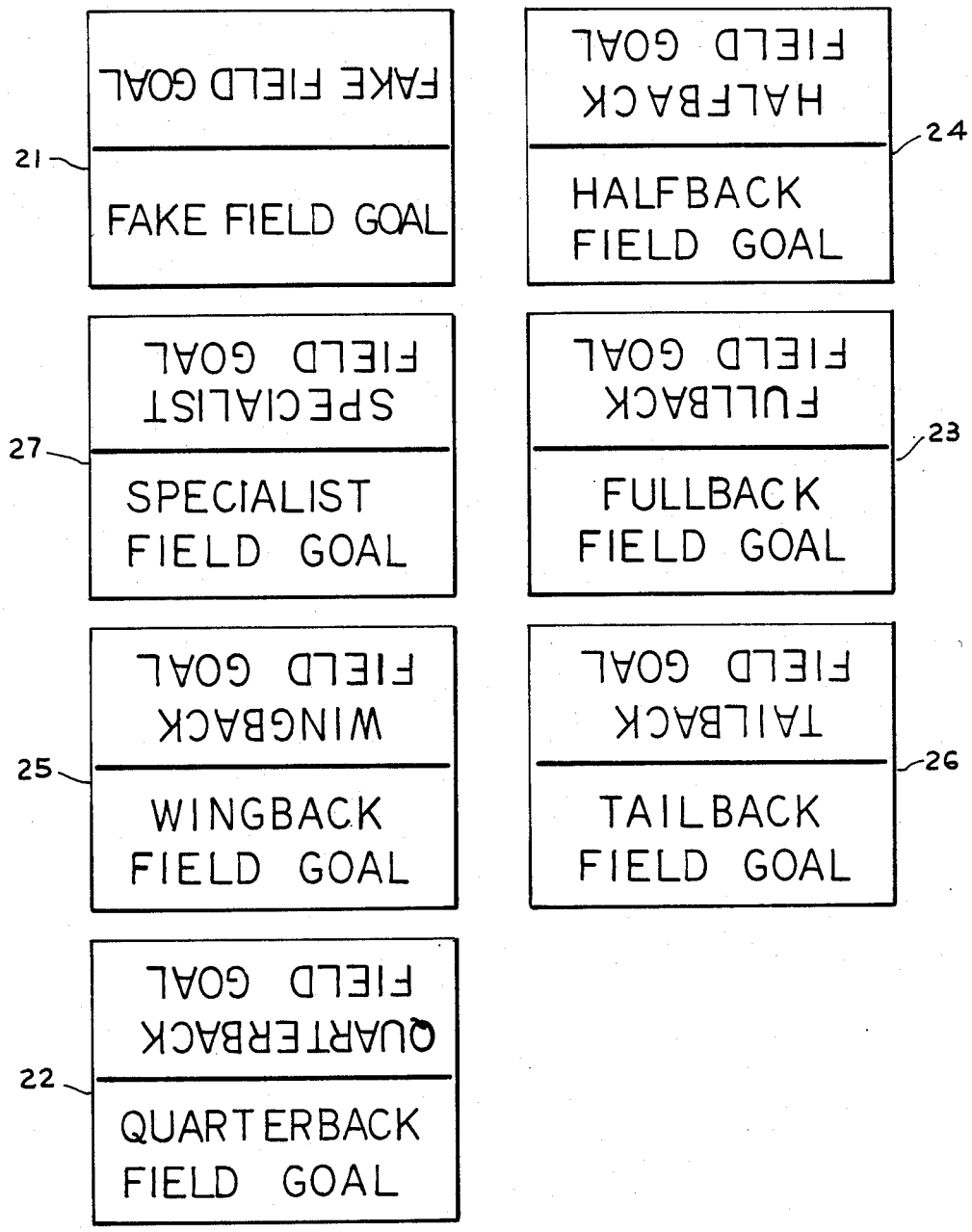
FIG. 16 shows the Field Goal cards.

In addition to the passing, running and punting categories, there is a field goal category, FIG. 16. There is: a fake field goal card 21; a quarterback field goal card 22; a fullback field goal card 23; a halfback field goal card 24; a wingback field goal card 25; a tailback field goal card 26; and a specialist field goal card 27.

In addition to the offensive play cards described herein above, there is a special defense card called the Blitz card, FIG. 11.

There is a Quick Kick card, FIG. 12, used as a surprise trick play by the offense on first, second or third downs. The quick kick takes the place of a punt, with the exception being the defense does not get a runback on the quick kick.

Provided in the invention are probability and statistic charts for each of the categories described hereinabove, FIGS. 4–9. The charts are set up as grids having vertical and horizontal columns. Each vertical column is segmented horizontally into 46 sections. Each horizontal section is numbered and those horizontal lines are identifiable by those numbers.

Looking at FIG. 4, the Pass category chart is illustrated. It is readily apparent that the vertical columns corresponding to each card of the Pass category is labeled. In the Pass category, FIG. 4, Outside Run category FIG. 5, and Inside Run category, FIG. 6, each card has four vertical columns representing various successes in the defense's ability to match or out guess the offense's strategy. The categories are Crunch, In Grasp, Half Clear, and Clear.

The Punt and Field Goal categories, FIGS. 8 and 9 respectively, have two vertical columns per card representing the degrees of success of the defense guessing the offense's strategy. Those categories are Crunch and Clear. In addition to the various categories, there is a chart for Kick Off and Runback, FIG. 7. This chart represents probably yardage in various kick offs, runback yardage from kick offs, runback yardage for interception, runback yardage on punts, runback yardage on blocked punts, runback yardage on field goals and runback yardage on blocked field goals.

Figure 2:
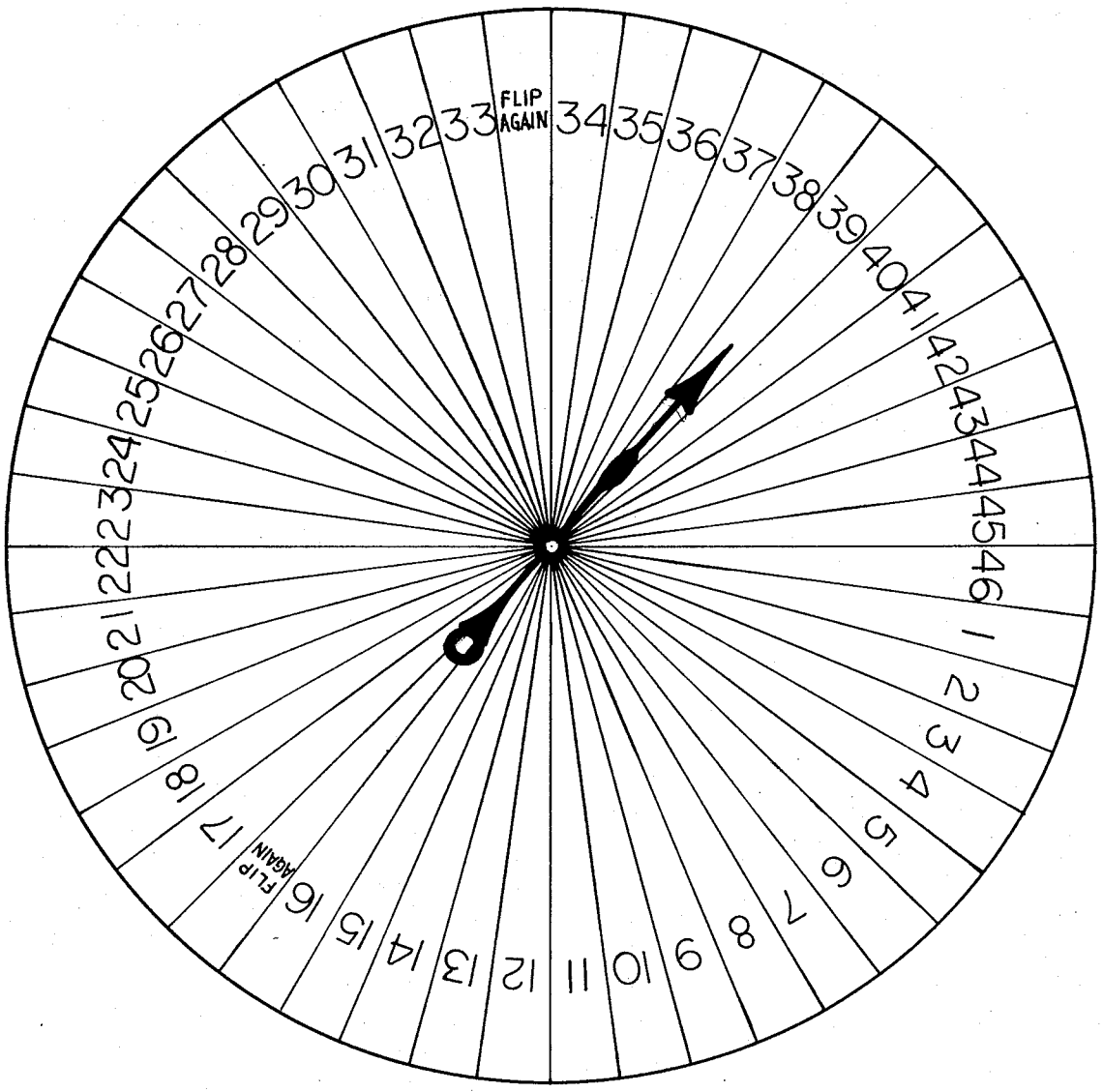
FIG. 2 is a diagrammatic depiction of a number spinner.

There is limited space in the charts for information so abbreviations have been used. The definitions for the abbreviations are as follows:

A. "p"—Penalty (Always refer to Penalty Spinner)
B. K.O.—Kickoff
C. R.B.—Runback
D. F.G.—Field Goal
E. "B"—Blocked Punt or Blocked Field Goal (Defense gets ball)
F. "F"Fumble (Defense automatically recovers the fumble)
G. F.C.—Fair Catch
H. F.C.F.—Fair Catch and Fumble
I. Inc.—Incomplete Pass
J. 10 I.—A pass thrown ten yards and intercepted
K. C 15—A complete pass for fifteen yards
L. S−8—A sack with a loss of eight yards
M. Q4—The quarterback runs for four yards
N. 0—No yardage on the play
O. 7—The play gained seven yards
P. −5—The play lost five yards
Q. L.O.S.—The line of scrimmage
R. N.F.L.—National Football League There is a chance random number selector represented in FIG. 2 as a spinner. This is to receive a random number. The number received corresponds to horizontal lines on the various charts.

Figure 3:
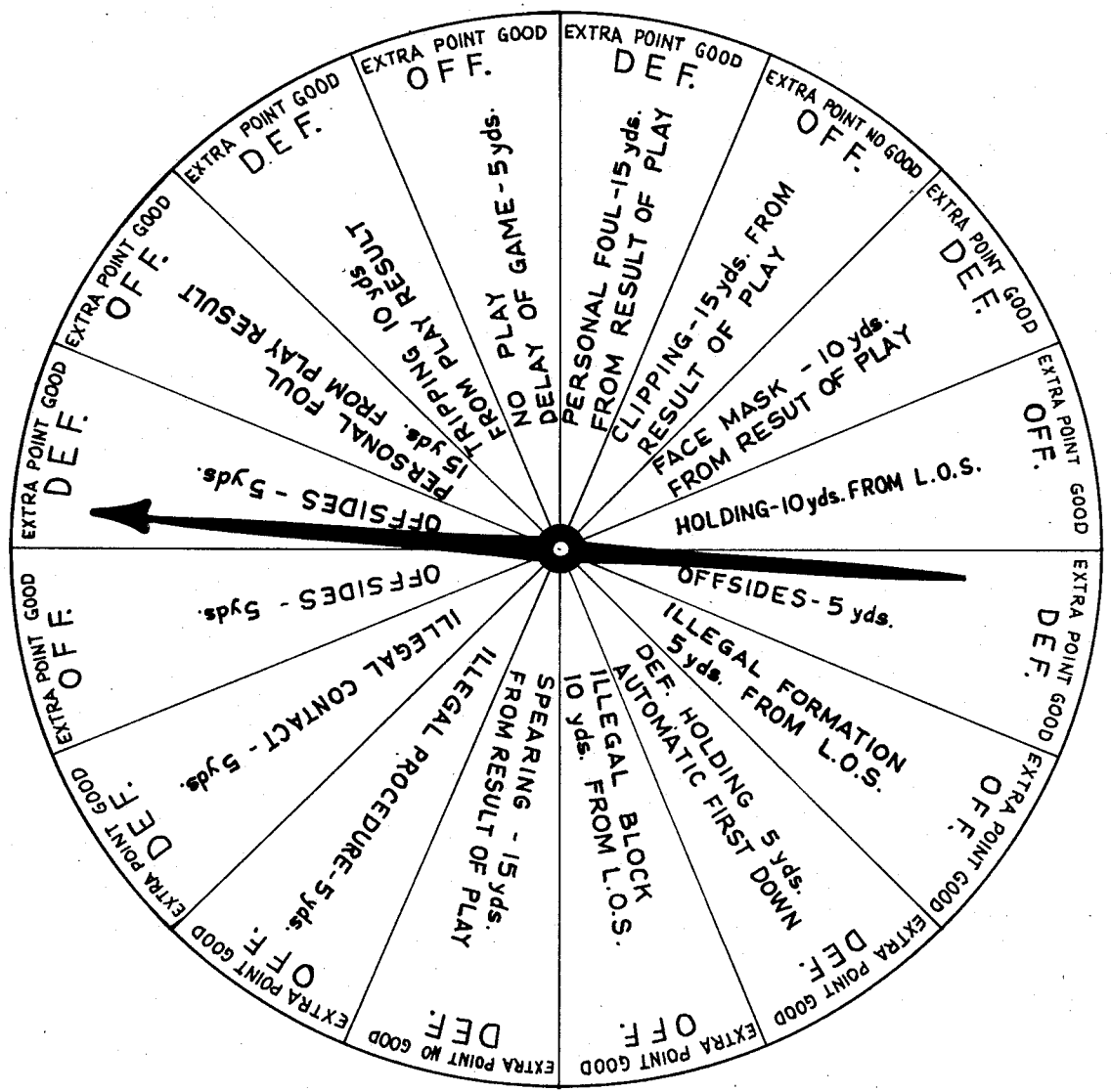
FIG. 3 is a diagrammatic depiction of a penalty and extra point spinner.

There is a random penalty selector illustrated in FIG. 3 as a spinner. This selector is referred to when a play result indicated on the various charts is "p".

There is an extra point selector, FIG. 3, for determining the success of extra points attempted after touchdowns have been obtained.

Having set out the minimal elements necessary to play the game, the game will now be described.

Except for the "special rules" of this game, the standard rules of the National Football League should be followed. The data i.e., play results, is based on the statistics of a typical professional football game, averaged from an entire football season.

The game consists of the offensive unit selecting a play from the "Play Selection Cards", and the defensive unit attempting to select what it feels the offense will choose. Each team has its own set of cards, the two sets being identical. The result of the play will depend on how well the defense analyzes the offensive play selection.

This game provides the player with the opportunity to be the Quarterback, Defensive Signal Caller, and Head Coach of his own team facing the same situations and decisions that are faced in a typical professional football game. Making the right decisions, and choosing the right play will play a big part in winning the game.

The special rules are as follows:

1. The game is played for 60 minutes with two 30 minute halves.

2. Each team has three time outs per half, and can only be used in the last minute of each half. No time elapses on the clock when a time out is used, including the play that follows the time out. For example, thirty seconds to go in the game and one of the two teams calls time out. The next play is run with no time elapsed, therefore, there is still thirty seconds left in the game. If a team wishes, it could call three time outs in a row and run three plays without any time elapsing on the clock. Either the offense or defense can use its time outs in the last minute.

3. Each team has the option of receiving a bonus play at the end of each half after time has expired.

4. There is a twenty second time limit for the offense or the defense to select its play. Failure to do so is automatically a fifteen yard penalty and an option by the team not receiving the penalty to add one more minute to the clock.

5. If a game ends in a tie, the winner of a coin flip gets its choice to receive or kickoff. The first team to score wins.

6. All fumbles are automatically recovered by the defense.

7. All blocked kicks are automatically recovered or picked up and run with by the defense.

8. Kickoffs are kicked from the minus thirty-five yard line.

9. All runbacks from blocked punts and blocked field goals are measured from the line of scrimmage.

For classification purposes the following rules apply:

1. The team kicking off is considered the Defense. The team receiving the kick off is the Offense.

2. The team punting or attempting a field goal is considered the Offense.

3. The team running back an interception, punt, or field goal is considered the Defense until the play is over.

The definitions of the football terms used in this game and in professional games are as follows:

A. Dropback Pass—Quarterback drops straight back from the center and throws a pass from behind the offensive line, considered the "Pocket".

B. Sprint Out Pass—Quarterback leaves the center and sprints around the end toward the sideline to throw a pass.

C. Fake Run and Pass—Quarterback fakes a handoff to a back running toward the middle of the line, then throws a pass.

D. Screen Pass—Quarterback drops back to throw a pass, the linemen block and let their men go. At the same time the Quarterback drops even further back drawing the rushing defensive linemen to him, then throwing a short pass to a receiver behind the line of scrimmage, who now has the offensive line in front of him to block.

E. End Run—The ball carrier runs wide to the sideline, around the end of the line.

F. Reverse—The runner starts an end run and hands the ball off to another runner going the opposite direction, who then circles the other end of the line of scrimmage. Normally, the reverse man is a wide receiver.

G. Power Sweep—The ball carrier circles the end with pulling guards running in front of him. The play is considered a power play around the end.

H. Counter Run—The runner starts one direction then cuts back another direction behind his blocker.

I. Off Tackle—A run that occurs over the offensive tackle position.

J. Up Middle—The play takes place where the center and quarterback started, right in the middle of the line of scrimmage.

K. Draw—Quarterback drops back to pass, and slips the ball to a runner who runs between the unsuspecting rushing defensive players.

L. Weakside Trap—Normally there are more offensive linemen on one side of the center than the other. The side with the fewest linemen is called the weakside, the other side is called the strongside. A trap is letting a defensive lineman run through the offensive line unblocked, and then blocking him one way or another by a blocker coming from his blind side.

M. Punt—When the offense chooses to give up the ball, it is to its advantage to kick the ball downfield. The ball is snapped directly to the punter who kicks the ball with his foot without the ball touching the ground.

N. Quick Kick—On first, second, or third down, a surprise punt.

O. Blocked Kick—A defensive man hits the ball while the kicker or punter is attempting to kick, or has kicked the ball.

P. Interception—When a pass is thrown by the offense and a defensive man catches the ball instead of an offensive receiver.

Q. Fumble—When an offensive player having possession of the ball drops the ball on the ground.

R. Onside Kick—A trick play by the team kicking off, to kick the ball and try to recover the kick before the team receiving the ball recovers it. The ball must travel ten yards before the kicking team can cover the kick.

S. Runback—The yardage gained by the team receiving a kick. In other words, the defense running the ball back toward the opposite goal line.

T. Sack—The quarterback tackled behind the line of scrimmage while attempting to throw a pass.

U. Blitz—The defense overloads a particular area and rushes extra men to stop the offensive play. In other words, concentrating on one area of the offense.

V. Line of Scrimmage—Where the ball is put into play, draw a line from the front tip of the football across the field parallel to the goal line. The line of scrimmage separates the defense from the offense.

W. End Zone—The area between the goal line and the back line. The goal post sets on the back line, and the end zone is ten yards in depth.

X. Turnover—A lost fumble or interception by the offense.

Strategy Options

The offense has four options to consider in structuring its strategy. The offense may:

1. Select a play from one of the three categories, "Pass", "Outside Run", or "Inside Run";

2. Quick Kick—Can only be done on first, second or third down;

3. Punt—The offense announces it is sending in its Punt Unit. The offense should then pick up its pile of Punt cards and select one of the nine punts as its play;

4. Kick a Field Goal—The offense announces it is sending in the Field Goal Unit. The offense should then pick up its pile of Field Goal Cards and select one of the seven field goals as its play.

Note: At the beginning of the game, each player should separate his or her Punt Cards and Field Goal Cards from the rest of the Play Selection Cards. Place the cards into two separate stacks in front of each player to be available whenever one decides to put his Punt Unit or Field Goal Unit into the game. It is much easier to handle the cards by reducing the number of cards in each player's hands;

As in live professional football, the defense must attempt to guess what the offense will do. The defense has five options or choices of strategy available:

1. Select a play from one of the three categories, "Pass", "Outside Run", or "Inside Run". If the defense is correct in selecting the same category as the offense, the play is over. If the defense on its first opportunity is incorrect in selecting the same category as the offense, it receives a second opportunity to hit the correct category as the offense. If the defense has to go to its second choice in order to hit the offense, it reduces the strength of the defense in stopping the offensive play. No matter whether the defense is correct or not on its second choice, the play is over. The result of the play will depend on how closely the defense analyzed the offensive play selection;

2. Blitz—If the defense decides to blitz, it only gets one opportunity to hit the correct category and play of the offense. The advantage of blitzing is that the defense gets to select three plays rather than one, therefore concentrating on one area of the offense. The three plays must come from only one category;

3. Quick Kick Card—If on first, second, or third down, the defense thinks the offense plans to quick kick, its first choice can be to use the Quick Kick Card. If correct, the play is over. If incorrect, the defense gets a second chance at the offense and selects a category and a play, following the same guidelines for the results of the play. The defense is not allowed to use its second choice to select Quick Kick. Therefore, if the defense does not select Quick Kick as its first choice and the offense has, the play is over;

4. If the offense has announced it chooses to punt, the defense picks up its Punt Cards and selects the punt it feels the offense will select. The defense has only one selection in this situation;

5. If the offense has announced it chooses to kick a field goal, the defense picks up its Field Goal Cards and selects the field goal its feels the offense will select. The defense has only one selection in this situation.

The charts in FIGS. 4–9 have columns as described above. The purpose of the columns is to measure the degree of success the defensive unit has in correctly analyzing the offense's play selection. As stated above there are four degrees of success. The columns marked "Crunch" means that the offensive play is in big trouble because the defense has met the play head on. The result is a high percentage of lost yardage and possible loss of the ball by the offense.

The column marked "In Grasp" means the offense has run into some problems and is attempting to break free of the grasp of the defense. Percentages are with the defense that the offense will not make yardage.

The column marked "Half Clear" means the offense has a good opportunity to make positive yardage.

The column marked "Clear" means the offense should break into the clear. It is this category that gives the offense its best percentage of making excellent yardage. Accordingly, looking at the situation where the defense has tried to guess the offense's play, there four degrees based on the offense's success: Excellent, Good, Fair and Poor.

Excellent is accorded the "Clear" column, Good is accorded the "Half Clear" column, Fair is accorded the "In Grasp" column and Poor is accorded the "Crunch" column where the defense has met the offense head on.

The "Clear Column" is used when these two situations occur:

1. The defense blitzes and fails to blitz the correct category of the offensive play. For example, the defense blitzes "Pass Category" and selects Dropback Pass, Screen Pass, and Sprint Out Pass. The offense has selected "Outside Run Category", End Run. The result is the offense is clear and uses the "Clear Column" of End Run for the play result.

2. The defense on its first selection chooses "Inside Run Category", Up Middle. The offense has selected "Pass Category", Dropback Pass. The offense informs the defense it is incorrect. The defense now has a second opportunity to select a play and chooses "Outside Run Category", Reverse. Again the defense fails to select the same category as the offense, therefore, the play result is found in the "Clear Column" of "Pass Category", Dropback Pass.

The only time the "Half Clear Column" is used is after the defense has failed to select the correct category on its first try, and on the defenses second opportunity it selects the same category as the offense, but misses in selecting the correct play. For example, the defense selects "Outside Run Category", Reverse. The offense has selected "Inside Run Category", Weakside Trap. The offense informs the defense it is incorrect on its first choice, and on its second opportunity the defense selects "Inside Run Category", Draw. By the game guidelines, the defense on its second opportunity has hit the same category as the offense but failed to select the correct play. Therefore, the play result will be found in the "Half Clear Column" of Weakside Trap.

The "In Grasp Column" is used when these three situations occur:

1. The defense blitzes and selects the same category as the offense but not the exact play. For example, the defense blitzes the "Inside Run Category" and selects its three plays to blitz, Up Middle, Weakside Trap, and Off Tackle. The offense has selected "Inside Run Category", Draw. The defense is in the correct category but fails to select the exact play, therefore the result of the play is found in the "In Grasp Column" of Draw.

2. The defense selects "Inside Run Category", Up Middle, the offense has selected "Inside Run Category" Draw. The defense has selected the correct category on its first opportunity but failed to select the exact play, therefore the play result is found in the "In Grasp Column" of Draw.

3. The defense selects "Pass Category" Screen Pass on its first selection. The offense has selected "Inside Run Category" Draw. The offense informs the defense it is incorrect. The defense on its second opportunity selects the exact play and category of the offense, "Inside Run Category" Draw. By the guideline of the game the result of the play is located in the "In Grasp Column" of Draw.

The "Crunch Column" is used when these three situations occur:

1. The defense blitzes and selects the exact category and play chosen by the offense. For example, defense blitzed "Outside Run Category" and selects End Run, Reverse, and Power Sweep as the three plays it is blitzing. The offense has selected "Outside Run Category" Reverse. The defense has hit the correct play, therefore the result is found in the "Crunch Column" of Reverse.

2. The defense on its first opportunity selects the exact category and play as the offense. For example, the defense selects "Outside Run Category" Reverse, the offense has selected the same play, therefore the result of the play is located in the "Crunch Column" of Reverse.

3. The defense on its first opportunity selects Quick Kick, and the offense has also selected Quick Kick. The offense selects a punt card and the "Crunch Column" of that particular punt is used to find the result of the play.

Only two columns are used for the kicking game, "Clear" and "Crunch". After the offense announces it is sending in its Punt or Field Goal Unit, the defense responds by selecting a Punt of Field Goal Play, depending on which the offense announces. The offense selects its particular Punt or Field Goal. If the defensive play matches up with the offensive play, use the "Crunch Column" of whatever kick was selected. If the defensive play fails to match with the offensive play, use the "Clear Column" of whatever kick was selected. The following chart describes examples of the possible combinations.

| | Examples of Possible Combinations | |
|---|---|---|
| Offensive Selection | Defensive Selection | Result of Play |
| Outside Run Category Power Sweep | 1. Inside Run Cateogry-Off Tackle 2. Pass Category - Dropback Pass | Use "Clear Column" of Power Sweep |
| Inside Run Category Draw | 1. Outside Run Category-Reverse 2. Pass Category-Sprintout Pass | Use "Clear Column" of Draw |
| Pass Category Fake Run and Pass | Defense blitzes Outside Run Category Reverse, End Run, and Counter Run | Use "Clear Column" of Fake Run and Pass |
| Ouick Kick Selects Specialist Punt | 1. Pass category - Dropback Pass Defense cannot select quick kick with its second choice play is over. | Use "Clear Column" of Specialist Punt |
| Outside Run Category End Run | 1. Ouick Kick 2. Pass Category - Sprint Out Pass | Use "Clear Column" of End Run |
| Announces Punt Selects Tight Punt | After Announcement selects Quarterback Punt | Use "Clear Column" of Tight Punt |
| Announces Field Goal Selects Wingback Field Goal | Hears Announcement and selects Fake Field Goal | Use "Clear Column" of Wingback Field Goal |
| Pass Category Fake Run and Pass | 1. Outside Run Category-End Run 2. Pass Category - Screen Pass | Use "Half-Clear Column" of Fake Run and Pass |
| Inside Run Category Up Middle | 1. Outside Run Category-Reverse 2. Inside Run Category-Draw | Use "Half-Clear Column" of Up Middle |
| Outside Run Category Counter Run | 1. Quick Kick 2. Outside Run Category-Reverse | Use "Half-Clear Column" of Counter Run |
| Inside Run Category Weakside Trap | 1. Inside Run Category-Up Middle | Use "In Grasp Column" of Weak-Side Trap |
| Outside Run Category End Run | 1. Pass Category - Dropback Pass 2. Outside Run Category - End Run | Use "In Grasp Column" of End Run |
| Pass Category Sprint Out Pass | 1. Quick Kick 2. Pass Category Spring Out Pass | Use "In Grasp Column" of Sprint Out Pass |
| Pass Category Fake Run and Pass | Defense blitzes Pass category Dropback Pass, Screen Pass and Sprint Out Pass | Use "In Grasp Column" of Fake Run and Pass |
| Outside Run Category Reverse | 1. Outside Run Category Reverse | Use "Crunch Column" of Reverse |
| Inside Run Category Weakside Trap | Defense blitzes Inside Run category Draw, Weakside Trap and Off Tackle | Use "Crunch Column" of Weak side Trap |
| Quick Kick selects Tight Punt | 1. Quick Kick | Use "Crunch Column" of Tight Punt |
| Announces Punt Selects Halfback Punt | After announcement selects Halfback Punt | Use "Crunch Column" of Half-back Punt |

-continued

| Offensive Selection | Examples of Possible Combinations<br>Defensive Selection | Result of Play |
|---|---|---|
| Announces Field Goal Selects Fullback Field Goal | After announcement selects Fullback Field Goal | Use "Crunch Column" of Fullback Field Goal |

Familiarity with the information thus far explained in this section of the specification will enable two teams to begin to play this simulated professional football game. The steps in the playing of the game as well as further analysis concerning this game follows.

A coin is flipped to decide which team kicks and which team receives. Each player should separate their play selection cards by placing the punt and field goal cards in two separate stacks. The cards kept in the players' hands are the 12 play selection cards, the blitz card and the quick kick card. The team kicking off, i.e., defense, spins the number spinner and looks up the results under the kick off column on the kick off chart. The team receiving, i.e., offense, spins the number spinner and looks up the results under the runback of the kick off on the appropriate chart. The team receiving has the option of taking the ball on the 20-yard line if the kick off goes beyond the goal line. After the kick off runback, both the offense and defense select a play from their "Play Selection Cards". The defense shows its first selection. If the defense is blitzing, it shows the blitz card to the offense and announces the category and the three plays it is blitzing. The offense now shows its play selection card to the defense. The column rules are now used and the offense spins the number spinner and looks up the results on the play selection chart. If the defense does not blitz, it receives two chances to hit the offense. On its first opportunity the defense selects its play and shows it to the offense. If the play is in the same category as the play selected by the offense, the offense then shows the defense its play selection. The column rules are now used and the offense spins the number spinner and looks up the result on the play result chart. If the first play selected by the defense is not in the same category as the offensive play, the offense informs the defense it is incorrect. The defense now uses the second selection, and shows it to the offense. The offense then shows the defense its play selection and the column rules are now used. The offense spins the number spinner and looks up the results on the play result chart.

Playing continues until the offense scores, punts, or turns the ball over. When the other team gets the ball, the same procedure is followed.

When the offense chooses to punt or kick a field goal, it announces this fact before either team has selected its play. both teams now pick up the field goal or punt cards whichever has been announced, and both make only one selection. As noted before, there are only two columns listed under punts and field goals, "Clear" and "Crunch". The column rules now would be used.

If on first, second or third down the offense chooses to punt, it should select the Quick Kick Card and not inform the defense it is punting. Use the same procedure that is used when selecting a category play. If the defense does not select the Quick Kick Card with its first option, the offense shows its Quick Kick Card to the defense and announces which punt play it has selected. The offense spins the Number Spinner and uses the "Clear Column" of its chosen punt for the results. If the defense selected the Quick Kick Card with its first choice, the offense still announces which punt it has chosen. The offense spins the Number Spinner and the result is found in the "Crunch Column" the selected punt play.

Description of the Category Plays

FIG. 17 represents the various plays indicated on the cards and how they should be conceptualized by various players in structuring their strategy.

Referring to FIG. 17, the individual plays will now be explained. Section A of FIG. 17 sets out the formation of the offensive line. The various positions and their alignment are shown: SE refers to split end, T refers to tackle, G refers to guard, C refers to center, TE refers to tight end, F refers to flanker, QB refers to quarterback, HB refers to halfback and FB refers to fullback.

Referring now to Section B of FIG. 17, the inside runs are shown. Inside runs are runs that occur between the two tackles. The halfback can do either a Weakside Trap or a Draw Play. The Weakside Trap is where the halfback runs between the left tackle and left guard. The Draw Play is where the halfback runs between the left guard and center. The fullback has two plays. The fullback may run between the center and right guard comprising the Up the Middle Play. The fullback may also run between the right tackle and tight end for the Off Tackle play.

Section C of FIG. 17 sets out the Outside Runs. Outside Runs are considered runs outside of the tackles. The backs can run directly around the ends for the power sweep and end runs where they take the ball and go directly around the end. Counter Run would be stepping to go one direction but actually countering back and going the other direction around the end. The fourth play in the Outside Runs would be the Reverse where the back starts out in one direction to run around the end and hands the ball to the split end coming back from the other direction and he then circles and runs around the other end.

Section D of FIG. 17 explains the various passes. There is four passes that are explained. The Dropback Pass is where the quarterback goes straight back from the center and throws a pass. A Fake Run and Pass is where he fakes the ball to the back who fakes a run up to the middle and the quarterback then drops back and throws a pass from behind the guard. A Sprint Out Pass is where the quarterback runs towards the sideline and throws the ball much like a ball carrier running the power sweep or end run. A Screen Pass is where the quarterback drops back, the halfback slides out in the flat and catches the ball with linemen in front of him and runs with the ball. This pass usually takes place on the weakside of the formation. Each individual play starts with the quarterback having the ball. The diagrams show who the quarterback hands, pitches or throws the ball to and where the play is designed to go. For interpretation purposes, the broken lines means the player does not have the ball and the solid lines mean the player has the ball.

The essence and import of each play is as follows:

"PASS CATEGORY"

DROPBACK PASS—Has the highest risk and biggest gainers of the four pass plays.

| | |
|---|---|
| SPRINT OUT PASS<br>FAKE RUN AND PASS | These two plays are very close in risk factor and big play opportunity. The two plays have less risk and less big plays than DROPBACK PASS but more than SCREEN PASS |

SCREEN PASS—the most conservative of the four pass plays.

"OUTSIDE RUN CATEGORY"

| | |
|---|---|
| END RUN<br>REVERSE | These two plays are very close in risk factor and big play opportunity. The two plays have the highest risk factors and biggest gainers of all the runs. |
| POWER SWEEP<br>COUNTER RUN | These two plays are very close in risk factor and big play opportunity. Although the two plays are not as dangerous or rewarding as the other two plays in this category, they still carry a moderate risk factor with opportunity for big gainers. |

"INSIDE RUN CATEGORY"

DRAW—This play has the highest risk factor and the most big play opportunities of the four inside run plays. The advantage of the DRAW PLAY is that it is in the most conservative category but it is not a conservative play. UP MIDDLE—The most conservative play in the offense. This play has minimum play loss, few turnovers, few big gainers, but may consistent gains.

| | |
|---|---|
| WEAKSIDE TRAP<br>OFF TACKLE | These two plays are very close in risk factor and big play opportunities. The two plays have less risk and less big plays than DRAW, but more than UP MIDDLE. |

RANKING THE PLAYS is performed using the following chart. The chart is based on five levels: high, medium high, average, medium low, and low.

| PLAY | BIG GAINERS | LOSS YARDAGE | TURNOVERS |
|---|---|---|---|
| Dropback Pass | High | High | High |
| End Run • | High | High | High |
| Reverse | High | High | High |
| Sprint Out Pass | Medium High | Medium High | Medium High |
| Fake Run And Pass | Medium High | Medium High | Medium High |
| Draw | Medium High | Medium High | Medium High |
| Screen Pass | Medium | Medium | Medium |
| Counter Run | Medium | Medium | Medium |
| Power Sweep | Medium | Medium | Medium |
| Off Tackle | Medium Low | Medium Low | Medium Low |
| Weakside Trap | Medium Low | Medium Low | Medium Low |
| Up Middle | Low | Low | Low |

Penalties

For each of the columns of the two charts the letter "p" occurs, which stands for penalty. The game is set up to have a penalty about 8% of the time, which is approximately what it is in a regular professional football game. Whenever the Number Spinner gives you a number that lands on "p", a penalty has been called. When this happens, flip the Number Spinner again to find the actual gain or loss of the play. If "p", comes up again, repeat the process until you get an actual play result. The next step is to flip the Penalty Spinner to find out who the penalty is against and what is the penalty. If there is more than one penalty, flip the Penalty Spinner for each penalty called. If both teams receive a penalty, by football rules the down is replayed because of the off setting penalties. If the same team receives two or more penalties, the other team can take the penalty of its choice, or refuse the penalty and take the actual play result, whichever benefits it the most. If only one penalty is called, the team not receiving the penalty has the choice of taking either the penalty or the actual play result. Found on the Penalty Spinner are sixteen penalties, eight against the offense, and eight against the defense.

The following is a list of penalties:

A. Against the Offense

1. OFFSIDES—5 yards from the original L.O.S., i.e. Line of scrimmage.
2. PERSONAL FOUL—15 yards from result of play.
3. DELAY OF GAME—5 yards and the play is void.
4. CLIPPING—15 yards from result of play.
5. HOLDING—10 yards from original L.O.S.
6. ILLEGAL FORMATION—5 yards from original L.O.S.
7. ILLEGAL BLOCK—10 yards from original L.O.S.
8. ILLEGAL PROCEDURE—5 yards from original L.O.S.

B. Against the Defense

1. OFFSIDES—5 yards from original L.O.S.
2. DEFENSIVE HOLDING—Automatic first down for the offense and 5 yards from orignal L.O.S.
3. SPEARING—15 yards from result of play.
4. ILLEGAL CONTACT—5 yards from original L.O.S.
5. TRIPPING—10 yards from result of play.
6. PERSONAL FOUL—15 yards from result of play.
7. FACE MASK—10 yards from result of play.

The foregoing discussion is focused on a board game embodiment in order to illustrate the precepts, concepts and principles of the present invention. As was stated above, the invention is generic to any such embodiment and many functional equivalents are conceivable. In construing the means plus function language of the claims, the following discussion is to be resorted to first before examining closely the four corners of the specification.

Means for representing a professional football field may be a gridiron representation reproduced on any planar member. The planar members may be products of wood or plastic or combinations of both. The planar member may be computer screen or any make shift depiction of gridiron. It is conceivable that the gridiron representation can be dispensed with in its entirity and a verbal or written description of the gridiron may be substituted in its place.

Means for representing the line of scrimmage may be any moveable indicator. The indicator may be an inanimate object composed of plastic or wood products or even a combination of both. The indicator may be pegged for use in holes situated upon the gridiron representation. The indicator may be a cursor or its functional equivalent on a computer screen. All that is necessary in order to satisfy the means for representing a line of scrimmage element is some indication of where the line of scrimmage is. It is conceivable that this element may be done away with completely and verbal or written descriptions may be substituted therefore.

Means for representing a 10 yard line first down position may be an inanimate indicator composed of plastic or wood or a combination of both. The crucial requirement for this element of the invention is that an indicator be situated on the gridiron representation such that it is clear to all players that a 10 yard line measured from the line of scrimmage in the first down is located for the purposes of achieving or defeating a new first down. It is conceivable that this element may be done away with entirely and verbal or written representations may be substituted therefore.

Means for indicating offensive and defensive plays shall be understood to refer to 2 decks of play cards. The decks are identical. Also included for special defense purposes is a blitz card. Also included for special offensive purposes is a quick kick card. All of the play cards but for the blitz card and the quick kick card are members of various categories or suits. Within each category or suit is located the individual possible plays. The Pass category has four plays. They are: Dropback Pass; Sprint Out Pass; Fake Run and Pass; and Screen Pass. The Outside Run category has four cards. They are: End Run; Counter Run; Power Sweep; and Reverse. The Inside Run category has four cards. The are: Up Middle; Off Tackle; Draw; and Weak Side Trap. The Punt category has nine cards. They are: Fake Punt; Quaterback Punt; Fullback Punt; Halfback Punt; Wingback Punt; Tailback Punt; Specialist Punt; Spread Punt and Tight Punt. The Field Goal category has seven cards. They are: Fake Field Goal; Quaterback Field Goal; Fullback Field Goal; Halfback Field Goal; Wingback Field Goal; Tailback Field Goal; and Specialist. References as to the meanings of these plays shall be made through the rest of the specification.

There are many ways of indicating these offensive and defensive plays other than by cards. All of the principal information concerning this invention may be stored on read only memory chips. The read only memory chips may be used in any computer device. It is conceivable that all the printable information of the invention may be put into random access memories associated with such computers as well. Accordingly, hardware and software may be used for any and all parts of this invention.

The play cards have the various plays depicted in one fashion or another on the cards themselves. The plays may be depicted with just their names, or pictographs depicting the actual plays themselves. The cards may be made of plastic or wood or combinations of both. It is conceivable the entire game may be represented on a piece of cloth or even scratched into the dirt.

Means for choosing a play by an offensive team may mean a team arbitrarily and randomly selecting one of the multitude of cards available to him. It may also mean using the computer or any other mode of analysis to come up with probabilities and indications which are to be used at a particular point in time. The means for choosing a play by an offensive team member may be planar members including keys on keyboards associated with business machines.

Means for estimating what the play is by a defensive team is similar to means for choosing a play by an offensive team. That is, it may mean the defensive team member randomly or arbitrarily choosing a card from an identical deck to the one used by the offensive team in attempting to guess what the offensive team strategy is. It may also mean using a computer to help analyze what the offensive team strategy may be. It may also mean planar member, including a key on a keyboard associated with business machines.

Means for assessing a degree of success in the estimating may be nothing more than documenting how many turns or opportunities for the closeness of the match which the defensive member has performed in guessing what the offensive team will be. It may also mean using a computer for this task. It may also mean a planar member including a button on a keyboard associated with business machines and the like used in playing the above outlined game.

Means for determining a random number may be a spinner or computerization of randomizing for a number. It is preferable that the number be randomly chosen between one and 46.

Means for using the random number to arrive at the play result may be nothing more than a player using said number in locating a horizontal line on a chart. It may also mean computerization to randomly choose a horizontal line. It may also mean randomization for choosing any point on a random access memory or read only memory containing a play result or a multitude of play results.

Means for arriving at a play result may mean the various play result charts as depicted in the drawings. It may also mean information stored in random access memory or read only memory in computers and business machines. It may also mean a planar member including a key for a keyboard associated with the business machines which would include computers.

Means for determining penalties may be a spinner as illustrated in the drawings. It may also mean information stored in random access memory or read only memory. It may also mean a planar member including keys on a keyboard associated with business machines and computers and the like. It may also mean specially designed dice.

Means for determining extra point success may be a spinner such as is shown in the drawings. It may also be information stored in random access memories or read only memories. It may also mean planar members including keys used on keyboards associated with business machines and computers and the like. It may also mean especially designed dice.

As this invention may be embodied in several forms without departing from the spirit or essential characteristics thereof, the present embodiment is therefore illustrative and not restrictive, and since the scope of the invention is defined by the appended claims, all changes that fall within the meets and bounds of the claims or that form their functional as well as their jointly cooperative equivalents are therefore intended to be embraced by those claims.

What I claim as my exclusive property is:

1. A football game apparatus, comprising:

(a) a playing board representing a football field;

(b) at least moveable pieces for the board to indicate a line of scrimmage and a ten yard line;

(c) first and second sets of playing cards, wherein a majority of the cards in said first set contain indicia identical to indicia contained in the cards of said second set, said indicia representing offensive plays, whereby one of said sets is used by an offensive team and another of said sets is used by a defensive team for attempting matching said cards;

(d) a first chart indicating offensive plays and results of various card matchings.

2. The device of claim 1, further comprising:

a second chart containing kicking and running back results of the various card matchings.

3. The device of claim 2 wherein said charts have identifiable lines indicating multiple degrees of success in the attempting of matching the cards.

4. The device of claim 3, further comprising:

means for random line selection.

5. The device of claim 4 wherein said means for random line selction is a number spinner.

6. The device of claim 5, further comprising:

means for deciding penalty results.

7. The device of claim 6 wherein said means for deciding penalty results is a spinner.

8. The device of claim 7, further comprising:

means for deciding extra point results.

9. The device of claim 8 wherein the means for deciding extra point results is a spinner.

10. A football game apparatus, comprising:

(a) means for representing a professional football field;

(b) means for representing a line of scrimmage on said field;

(c) means for representing a 10 yard line first down position relative to said line of scrimmage;

(d) means for indicating offensive plays used on said field, wherein said means comprises first and second sets of playing cards, wherein a majority of the cards in said first set contain indicia identical to indicia contained in the cards of said secod set, said indicia representing offensive plays, whereby one of said sets is used by an offensive team and another of said sets is used by a defensive team for attempting matching said cards;

(e) means for choosing a play for an offensive team;

(f) means for estimating what the play is for a defensive team;

(g) means for assessing degrees of success in the estimating;

(h) means for determining a random number;

(i) means for using the random number and degree of success to arrive at a play result;

(j) means for arriving at a play result, whereby the line of scrimmage may be manipulated.

11. The apparatus of claim 10 further comprising means for determining penalties.

12. The apparatus of claim 11 further comprising means for determing extra point success.

* * * * *